US010760382B2

(12) United States Patent
Mau et al.

(10) Patent No.: US 10,760,382 B2
(45) Date of Patent: Sep. 1, 2020

(54) INNER AND OUTER DOWNHOLE STRUCTURES HAVING DOWNLINK ACTIVATION

(71) Applicants: Fabian Mau, Vechelde (DE); Heiko Eggers, Bad Fallingbostel (DE); Henning Melles, Celle (DE); Thorsten Regener, Wienhausen (DE); Ingo Roders, Seelze (DE); Matthias Wauer, Winsen (DE)

(72) Inventors: Fabian Mau, Vechelde (DE); Heiko Eggers, Bad Fallingbostel (DE); Henning Melles, Celle (DE); Thorsten Regener, Wienhausen (DE); Ingo Roders, Seelze (DE); Matthias Wauer, Winsen (DE)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 239 days.

(21) Appl. No.: 15/715,298

(22) Filed: Sep. 26, 2017

(65) Prior Publication Data

US 2019/0093459 A1 Mar. 28, 2019

(51) Int. Cl.
*E21B 43/10* (2006.01)
*E21B 34/14* (2006.01)
(Continued)

(52) U.S. Cl.
CPC ..... *E21B 43/10* (2013.01); *E21B 23/01* (2013.01); *E21B 23/02* (2013.01); *E21B 34/14* (2013.01);
(Continued)

(58) Field of Classification Search
CPC ..... E21B 43/10; E21B 23/02; E21B 34/14; E21B 47/12; E21B 23/01; E21B 33/128; E21B 34/06; E21B 47/06
See application file for complete search history.

(56) References Cited

U.S. PATENT DOCUMENTS 9,004,195 B2 * 4/2015 Regener ..... E21B 33/14 166/177.4
10,060,256 B2 * 8/2018 Halfmann ..... E21B 33/12
(Continued)

OTHER PUBLICATIONS

International Search Report, International Application No. PCT/US2018/051981, dated Jan. 31, 2019, Korean Intellectual Property Office; International Search Report 8 pages.
(Continued)

*Primary Examiner* — Michael R Wills, III
(74) *Attorney, Agent, or Firm* — Cantor Colburn LLP

(57) ABSTRACT

Systems and methods to perform a downhole operations in a borehole comprising moving, using surface equipment, an inner structure and an outer structure within the borehole, the outer structure equipped with an interaction device and the inner structure configured to be moved relative to the outer structure in a direction parallel to the borehole by the surface equipment, transmitting, by a transmitter, a downlink instruction to the inner structure, and performing an interaction routine with the interaction device in response to the downlink instruction, wherein the interaction routine comprises an interaction at least partially outside of the outer structure to perform the downhole operation.

20 Claims, 9 Drawing Sheets

(51) Int. Cl.

| | |
|---|---|
| ***E21B 23/02*** | (2006.01) |
| ***E21B 23/01*** | (2006.01) |
| ***E21B 47/12*** | (2012.01) |
| *E21B 47/06* | (2012.01) |
| *E21B 34/06* | (2006.01) |

(52) U.S. Cl.
CPC ..... *E21B 47/12* (2013.01); *E21B 34/06* (2013.01); *E21B 47/06* (2013.01)

(56) References Cited

U.S. PATENT DOCUMENTS

| | | | | |
|---|---|---|---|---|
| 2009/0107675 | A1 | 4/2009 | Eriksen et al. | |
| 2012/0181044 | A1 | 7/2012 | Nikiforuk | |
| 2014/0008083 | A1* | 1/2014 | Ring | E21B 23/06 166/382 |
| 2014/0034311 | A1 | 2/2014 | Lirette et al. | |
| 2014/0041881 | A1 | 2/2014 | Dirksen et al. | |
| 2015/0034305 | A1* | 2/2015 | Tips | E21B 47/12 166/250.01 |
| 2015/0176369 | A1* | 6/2015 | Nguyen | E21B 34/066 166/308.1 |
| 2016/0312579 | A1* | 10/2016 | Green | E21B 34/10 |
| 2017/0138183 | A1* | 5/2017 | Halfmann | E21B 33/12 |

OTHER PUBLICATIONS

International Written Opinion, International Application No. PCT/US2018/051981, dated Jan. 31, 2019, Korean Intellectual Property Office; International Written Opinion 9 pages.

* cited by examiner

INNER AND OUTER DOWNHOLE STRUCTURES HAVING DOWNLINK ACTIVATION

BACKGROUND

1. Field of the Invention

The present invention generally relates to downhole operations and downlink activation of components used in downhole operations.

2. Description of the Related Art

Boreholes are drilled deep into the earth for many applications such as carbon dioxide sequestration, geothermal production, and hydrocarbon exploration and production. In all of the applications, the boreholes are drilled such that they pass through or allow access to a material (e.g., a gas or fluid) contained in a formation located below the earth's surface. Different types of tools and instruments may be disposed in the boreholes to perform various tasks and measurements.

In general, completion equipment such as liner hangers are hydraulically activated within the borehole. A work string containing a liner running tool includes a pack-off to isolate an activation port of the liner hanger and a ball seat. A ball is dropped downhole and pump pressure is transferred to the activation piston of the liner hanger. The activation piston thus engages the liner hanger with a liner. The disclosure herein provides improvements to activating components downhole, such as activation of liner hangers.

SUMMARY

Disclosed herein are systems and methods for performing downhole operations in a borehole comprising moving, using surface equipment, an inner structure and an outer structure within the borehole, the outer structure equipped with an interaction device and the inner structure configured to be moved relative to the outer structure in a direction parallel to the borehole by the surface equipment, transmitting, by a transmitter, a downlink instruction to the inner structure, and performing an interaction routine with the interaction device in response to the downlink instruction, wherein the interaction routine comprises an interaction at least partially outside of the outer structure to perform the downhole operation.

BRIEF DESCRIPTION OF THE DRAWINGS

The subject matter, which is regarded as the invention, is particularly pointed out and distinctly claimed in the claims at the conclusion of the specification. The foregoing and other features and advantages of the invention are apparent from the following detailed description taken in conjunction with the accompanying drawings, wherein like elements are numbered alike, in which:

DETAILED DESCRIPTION

Figure 1:
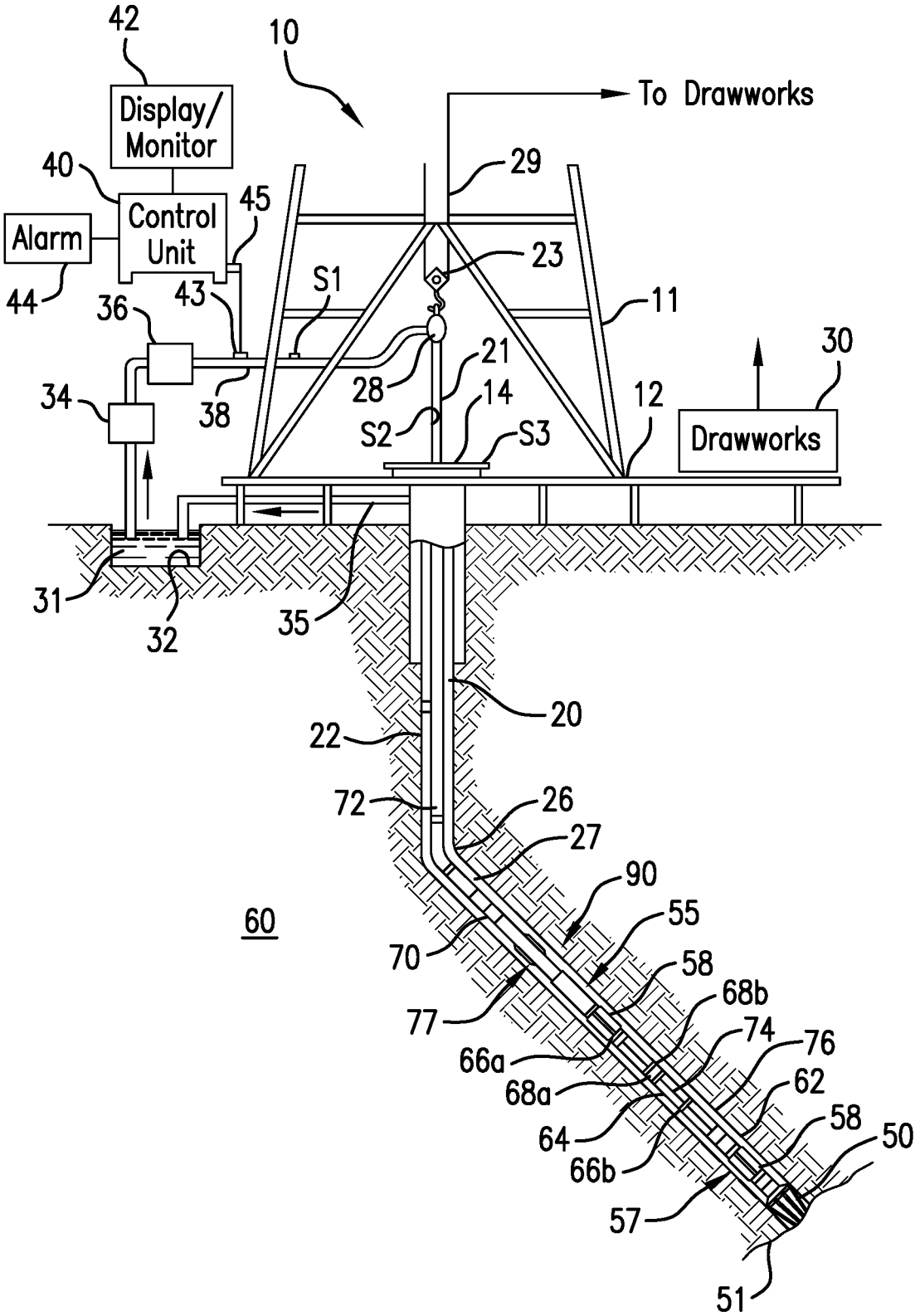
FIG. 1 is an example of a system for performing downhole operations that can employ embodiments of the present disclosure.

FIG. 1 shows a schematic diagram of a system for performing downhole operations. As shown, the system is a drilling system 10 that includes a drill string 20 having a drilling assembly 90, also referred to as a bottomhole assembly (BHA), conveyed in a borehole 26 penetrating an earth formation 60. The drilling system 10 includes a conventional derrick 11 erected on a floor 12 that supports a rotary table 14 that is rotated by a prime mover, such as an electric motor (not shown), at a desired rotational speed. The drill string 20 includes a drilling tubular 22, such as a drill pipe, extending downward from the rotary table 14 into the borehole 26. A disintegrating tool 50, such as a drill bit attached to the end of the BHA 90, disintegrates the geological formations when it is rotated to drill the borehole 26. The drill string 20 is coupled to surface equipment such as systems for lifting, rotating, and/or pushing, including, but not limited to, a drawworks 30 via a kelly joint 21, swivel 28 and line 29 through a pulley 23. In some embodiments, the surface equipment may include a top drive (not shown). During the drilling operations, the drawworks 30 is operated to control the weight on bit, which affects the rate of penetration. The operation of the drawworks 30 is well known in the art and is thus not described in detail herein.

During drilling operations a suitable drilling fluid 31 (also referred to as the "mud") from a source or mud pit 32 is circulated under pressure through the drill string 20 by a mud pump 34. The drilling fluid 31 passes into the drill string 20 via a desurger 36, fluid line 38 and the kelly joint 21. The drilling fluid 31 is discharged at the borehole bottom 51 through an opening in the disintegrating tool 50. The drilling fluid 31 circulates uphole through the annular space 27 between the drill string 20 and the borehole 26 and returns to the mud pit 32 via a return line 35. A sensor S1 in the line 38 provides information about the fluid flow rate. A surface torque sensor S2 and a sensor S3 associated with the drill string 20 respectively provide information about the torque and the rotational speed of the drill string. Additionally, one or more sensors (not shown) associated with line 29 are used to provide the hook load of the drill string 20 and about other desired parameters relating to the drilling of the wellbore 26. The system may further include one or more downhole sensors 70 located on the drill string 20 and/or the BHA 90.

In some applications the disintegrating tool 50 is rotated by only rotating the drill pipe 22. However, in other applications, a drilling motor 55 (mud motor) disposed in the drilling assembly 90 is used to rotate the disintegrating tool 50 and/or to superimpose or supplement the rotation of the drill string 20. In either case, the rate of penetration (ROP) of the disintegrating tool 50 into the borehole 26 for a given formation and a drilling assembly largely depends upon the weight on bit and the drill bit rotational speed. In one aspect of the embodiment of FIG. 1, the mud motor 55 is coupled to the disintegrating tool 50 via a drive shaft (not shown) disposed in a bearing assembly 57. The mud motor 55 rotates the disintegrating tool 50 when the drilling fluid 31 passes through the mud motor 55 under pressure. The bearing assembly 57 supports the radial and axial forces of the disintegrating tool 50, the downthrust of the drilling motor and the reactive upward loading from the applied weight on bit. Stabilizers 58 coupled to the bearing assembly 57 and other suitable locations act as centralizers for the lowermost portion of the mud motor assembly and other such suitable locations.

A surface control unit 40 receives signals from the downhole sensors 70 and devices via a transducer 43, such as a pressure transducer, placed in the fluid line 38 as well as from sensors S1, S2, S3, hook load sensors, RPM sensors, torque sensors, and any other sensors used in the system and processes such signals according to programmed instructions provided to the surface control unit 40. The surface control unit 40 displays desired drilling parameters and other information on a display/monitor 42 for use by an operator at the rig site to control the drilling operations. The surface control unit 40 contains a computer, memory for storing data, computer programs, models and algorithms accessible to a processor in the computer, a recorder, such as tape unit, memory unit, etc. for recording data and other peripherals. The surface control unit 40 also may include simulation models for use by the computer to processes data according to programmed instructions. The control unit responds to user commands entered through a suitable device, such as a keyboard. The control unit 40 is adapted to activate alarms 44 when certain unsafe or undesirable operating conditions occur.

The drilling assembly 90 also contains other sensors and devices or tools for providing a variety of measurements relating to the formation surrounding the borehole and for drilling the wellbore 26 along a desired path. Such devices may include a device for measuring the formation resistivity near and/or in front of the drill bit, a gamma ray device for measuring the formation gamma ray intensity and devices for determining the inclination, azimuth and position of the drill string. A formation resistivity tool 64, made according an embodiment described herein may be coupled at any suitable location, including above a lower kick-off subassembly 62, for estimating or determining the resistivity of the formation near or in front of the disintegrating tool 50 or at other suitable locations. An inclinometer 74 and a gamma ray device 76 may be suitably placed for respectively determining the inclination of the BHA and the formation gamma ray intensity. Any suitable inclinometer and gamma ray device may be utilized. In addition, an azimuth device (not shown), such as a magnetometer or a gyroscopic device, may be utilized to determine the drill string azimuth. Such devices are known in the art and therefore are not described in detail herein. In the above-described exemplary configuration, the mud motor 55 transfers power to the disintegrating tool 50 via a hollow shaft that also enables the drilling fluid to pass from the mud motor 55 to the disintegrating tool 50. In an alternative embodiment of the drill string 20, the mud motor 55 may be coupled below the formation resistivity tool 64 or at any other suitable place.

Still referring to FIG. 1, other logging-while-drilling (LWD) devices (generally denoted herein by numeral 77), such as devices for measuring formation porosity, permeability, density, rock properties, fluid properties, etc. may be placed at suitable locations in the drilling assembly 90 for providing information useful for evaluating the subsurface formations along borehole 26. Such devices may include, but are not limited to, temperature measurement tools, pressure measurement tools, borehole diameter measuring tools (e.g., a caliper), acoustic tools, nuclear tools, nuclear magnetic resonance tools and formation testing and sampling tools.

The above-noted devices transmit data to a downhole telemetry system 72, which in turn transmits the received data uphole to the surface control unit 40. The downhole telemetry system 72 also receives signals and data from the surface control unit 40 including a transmitter and transmits such received signals and data to the appropriate downhole devices. In one aspect, a mud pulse telemetry system may be used to communicate data between the downhole sensors 70 and devices and the surface equipment during drilling operations. A transducer 43 placed in the mud supply line 38 detects the mud pulses responsive to the data transmitted by the downhole telemetry system 72. Transducer 43 generates electrical signals in response to the mud pressure variations and transmits such signals via a conductor 45 to the surface control unit 40. In other aspects, any other suitable telemetry system may be used for two-way data communication (e.g., downlink and uplink) between the surface and the BHA 90, including but not limited to, an acoustic telemetry system, an electro-magnetic telemetry system, an optical telemetry system, a wired pipe telemetry system which may utilize wireless couplers or repeaters in the drill string or the wellbore. The wired pipe may be made up by joining drill pipe sections, wherein each pipe section includes a data communication link that runs along the pipe. The data connection between the pipe sections may be made by any suitable method, including but not limited to, hard electrical or optical connections, induction, capacitive, resonant coupling, or directional coupling methods. In case a coiled-tubing is used as the drill pipe 22, the data communication link may be run along a side of the coiled-tubing.

The drilling system described thus far relates to those drilling systems that utilize a drill pipe to conveying the drilling assembly 90 into the borehole 26, wherein the weight on bit is controlled from the surface, typically by controlling the operation of the drawworks. However, a large number of the current drilling systems, especially for drilling highly deviated and horizontal wellbores, utilize coiled-tubing for conveying the drilling assembly downhole.

In such application a thruster is sometimes deployed in the drill string to provide the desired force on the drill bit. Also, when coiled-tubing is utilized, the tubing is not rotated by a rotary table but instead it is injected into the wellbore by a suitable injector while the downhole motor, such as mud motor 55, rotates the disintegrating tool 50. For offshore drilling, an offshore rig or a vessel is used to support the drilling equipment, including the drill string.

Still referring to FIG. 1, a formation resistivity tool 64 may be provided that includes, for example, a plurality of antennas including, for example, transmitters 66*a* or 66*b* and/or receivers 68*a* or 68*b*. Resistivity can be one formation property that is of interest in making drilling decisions. Those of skill in the art will appreciate that other formation property tools can be employed with or in place of the formation resistivity tool 64.

Liner drilling can be one configuration or operation used for providing a disintegrating device becomes more and more attractive in the oil and gas industry as it has several advantages compared to conventional drilling. One example of such configuration is shown and described in commonly owned U.S. Pat. No. 9,004,195, entitled "Apparatus and Method for Drilling a Wellbore, Setting a Liner and Cementing the Wellbore During a Single Trip," which is incorporated herein by reference in its entirety. Importantly, despite a relatively low rate of penetration, the time of getting the liner to target is reduced because the liner is run in-hole while drilling the wellbore simultaneously. This may be beneficial in swelling formations where a contraction of the drilled well can hinder an installation of the liner later on. Furthermore, drilling with liner in depleted and unstable reservoirs minimizes the risk that the pipe or drill string will get stuck due to hole collapse.

Although FIG. 1 is shown and described with respect to a drilling operation, those of skill in the art will appreciate that similar configurations, albeit with different components, can be used for performing different downhole operations. For example, wireline, coiled tubing, and/or other configurations can be used as known in the art. Further, production configurations can be employed for extracting and/or injecting materials from/into earth formations. Thus, the present disclosure is not to be limited to drilling operations but can be employed for any appropriate or desired downhole operation(s).

Figure 2:
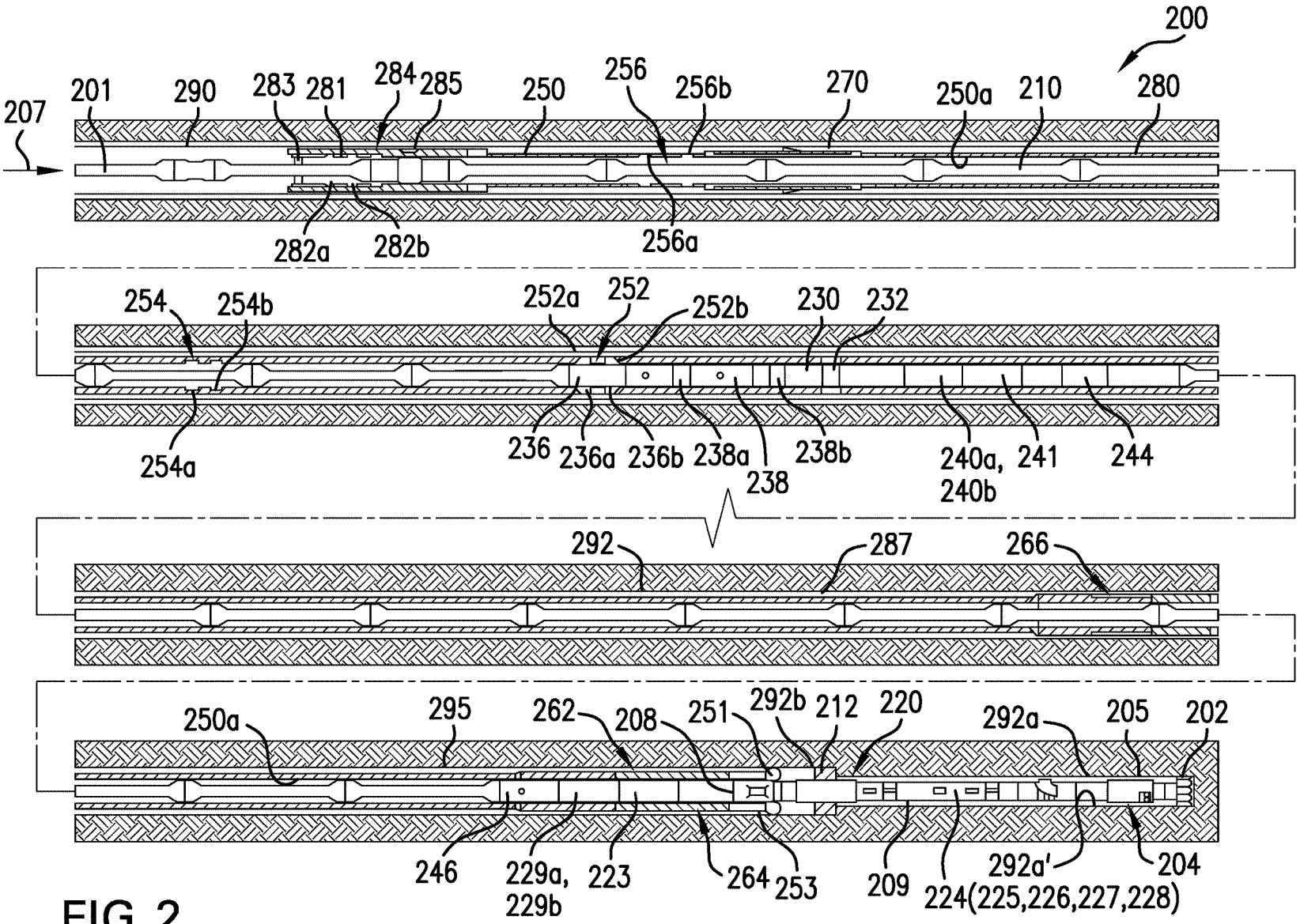
FIG. 2 is a line diagram of an example drill string that includes an inner string and an outer string, wherein the inner string is connected to a first location of the outer string to drill a hole of a first size that can employ embodiments of the present disclosure.

Turning now to FIG. 2, a schematic line diagram of an example system 200 that includes an inner structure 210 disposed in an outer structure 250 is shown. In this embodiment, the inner structure 210 is an inner string, including a bottomhole assembly, as described below. Further, as illustrated, the outer structure 250 is a casing or outer string. The inner structure 210 includes various tools that are moveable within and relative to the outer structure 250. In accordance with embodiments of the present disclosure, the inner structure 210 and the outer structure 250 may be moved by surface equipment either together or independently from each other. As described herein, various of the tools of the inner structure 210 can act upon and/or with portions of the outer structure 250 to perform certain downhole operations. Further, various of the tools of the inner structure 210 can extend beyond the outer structure 250 to perform other downhole operations, such as drilling.

In this embodiment, the inner structure 210 is adapted to pass through the outer structure 250 and connect to the inside 250*a* of the outer structure 250 at a number of spaced apart locations (also referred to herein as the "landings" or "landing locations"). The shown embodiment of the outer structure 250 includes three landings, namely a lower landing 252, a middle landing 254 and an upper landing 256. The inner structure 210 includes a drilling assembly or disintegrating assembly 220 (also referred to as the "bottomhole assembly") connected to a bottom end of a tubular member 201, such as a string of jointed pipes or a coiled tubing. The drilling assembly 220 includes a first disintegrating device 202 (also referred to herein as a "pilot bit") at its bottom end for drilling a borehole of a first size 292*a* (also referred to herein as a "pilot hole"). The drilling assembly 220 further includes a steering device 204 that in some embodiments may include a number of force application members 205 configured to extend from the drilling assembly 220 to apply force on a wall 292*a*' of the pilot hole 292*a* drilled by the pilot bit 202 to steer the pilot bit 202 along a selected direction, such as to drill a deviated pilot hole. The drilling assembly 220 may also include a drilling motor 208 (also referred to as a "mud motor") configured to rotate the pilot bit 202 when a fluid 207 under pressure is supplied to the inner structure 210.

In the configuration of FIG. 2, the drilling assembly 220 is also shown to include an under reamer 212 that can be extended from and retracted toward a body of the drilling assembly 220, as desired, to enlarge the pilot hole 292*a* to form a wellbore 292*b*, to at least the size of the outer string. In various embodiments, for example as shown, the drilling assembly 220 includes a number of sensors (collectively designated by numeral 209) for providing signals relating to a number of downhole parameters, including, but not limited to, various properties or characteristics of a formation 295 and parameters relating to the operation of the system 200. The drilling assembly 220 also includes a control circuit (also referred to as a "controller") 224 that may include circuits 225 to condition the signals from the various sensors 209, a processor 226, such as a microprocessor, a data storage device 227, such as a solid-state memory, and programs 228 accessible to the processor 226 for executing instructions contained in the programs 228. The controller 224 communicates with a surface controller (not shown) via a suitable telemetry device 229*a* that provides two-way communication between the inner structure 210 and the surface controller. The telemetry unit 229*a* may utilize any suitable data communication technique, including, but not limited to, mud pulse telemetry, acoustic telemetry, electromagnetic telemetry, and wired pipe. A power generation unit 229*b* in the inner structure 210 provides electrical power to the various components in the inner structure 210, including the sensors 209 and other components in the drilling assembly 220. The drilling assembly 220 also may include a second power generation device 223 capable of providing electrical power independent from the presence of the power generated using the drilling fluid 207 (e.g., third power generation device 240*b* described below).

In various embodiments, such as that shown, the inner structure 210 may further include a sealing device 230 (also referred to as a "seal sub") that may include a sealing element 232, such as an expandable and retractable packer, configured to provide a flow barrier or fluid seal between the inner structure 210 and the outer structure 250 when the sealing element 232 is activated to be in an expanded state. Additionally, the inner structure 210 may include a liner drive sub 236 that includes attachment devices 72

, 236*b* (e.g., latching elements, anchors, slips, etc.) that may be removably connected to any of the landing locations in the outer structure 250. The attachment devices 236*a*, 236*b* are also referred to herein as "outer engagement elements." The inner structure 210 may further include a hanger activation device or sub 238 including an activation tool, having seal members 238*a*, 238*b* configured to activate a rotatable hanger 270 in the outer structure 250. The inner structure 210 may include a third power generation device 240*b*, such as a turbine-driven device, operated by the fluid 207 flowing through the inner sting 210 configured to generate electric power, and a second two-way telemetry device 240*a*, including a transmitter, utilizing any suitable communication technique, including, but not limited to, mud pulse, acoustic, electromagnetic and wired pipe telemetry. The inner structure 210 may further include a fourth power generation device 241, independent from the presence of a power generation source using drilling fluid 207, such as batteries. The inner structure 210 may further include pup joints 244 and a burst sub 246.

Still referring to FIG. 2, the outer structure 250 includes a liner 280 that may house or contain a second disintegrating device 251 (e.g., also referred to herein as a reamer bit) at its lower end thereof. The reamer bit 251 is configured to enlarge a leftover portion of hole 292*a* made by the pilot bit 202. In aspects, attaching the inner string at the lower landing 252 enables the inner structure 210 to drill the pilot hole 292*a* and the under reamer 212 to enlarge it to the borehole of size 292 that is at least as large as the outer structure 250. Attaching the inner structure 210 at the middle landing 254 enables the reamer bit 251 to enlarge the section of the hole 292*a* not enlarged by the under reamer 212 (also referred to herein as the "leftover hole" or the "remaining pilot hole"). Attaching the inner structure 210 at the upper landing 256, enables cementing an annulus 287 between the liner 280 and the formation 295 without pulling the inner structure 210 to the surface, i.e., in a single trip of the system 200 downhole. The lower landing 252 includes a female spline 252*a* and a collet groove 252*b* for attaching to the attachment devices 236*a* and 236*b* of the liner drive sub 236. Similarly, the middle landing 254 includes a female spline 254*a* and a collet groove 254*b* and the upper landing 256 includes a female spline 256*a* and a collet groove 256*b*. Any other suitable attaching and/or latching mechanisms for connecting the inner structure 210 to the outer structure 250 may be utilized for the purpose of this disclosure.

The outer structure 250 may further include a flow control device 262, such as a backflow prevention assembly or device, placed on the inside 250*a* of the outer structure 250 proximate to its lower end 253. In FIG. 2, the flow control device 262 is in a deactivated or open position. In such a position, the flow control device 262 allows fluid communication between the wellbore 292 and the inside 250*a* of the outer structure 250. In some embodiments, the flow control device 262 can be activated (i.e., closed) when the pilot bit 202 is retrieved inside the outer structure 250 to prevent fluid communication from the wellbore 292 to the inside 250*a* of the outer structure 250. The flow control device 262 is deactivated (i.e., opened) when the pilot bit 202 is extended outside the outer structure 250. In one aspect, the force application members 205 or another suitable device may be configured to activate the flow control device 262.

A reverse flow control device 266, such as a reverse flapper or other backflow prevention structure, also may be provided to prevent fluid communication from the inside of the outer structure 250 to locations below the reverse flow control device 266. The outer structure 250 also includes a hanger 270 that may be activated by the hanger activation sub 238 to anchor the outer structure 250 to the host casing 290. The host casing 290 is deployed in the wellbore 292 prior to drilling the wellbore 292 with the system 200. In one aspect, the outer structure 250 includes a sealing device 285 to provide a seal between the outer structure 250 and the host casing 290. The outer structure 250 further includes a receptacle 284 at its upper end that may include a protection sleeve 281 having a female spline 282*a* and a collet groove 282*b*. A debris barrier 283 may also be provided to prevent cuttings made by the pilot bit 202, the under reamer 212, and/or the reamer bit 251 from entering the space or annulus between the inner structure 210 and the outer structure 250.

To drill the wellbore 292, the inner structure 210 is placed inside the outer structure 250 and attached to the outer structure 250 at the lower landing 252 by activating the attachment devices 236*a*, 236*b* of the liner drive sub 236 as shown. This liner drive sub 236, when activated, connects the attachment device 236*a* to the female splines 252*a* and the attachment device 236*b* to the collet groove 252*b* in the lower landing 252. In this configuration, the pilot bit 202 and the under reamer 212 extend past the reamer bit 251. In operation, the drilling fluid 207 powers the drilling motor 208 that rotates the pilot bit 202 to cause it to drill the pilot hole 292*a* while the under reamer 212 enlarges the pilot hole 292*a* to the diameter of the wellbore 292. The pilot bit 202 and the under reamer 212 may also be rotated by rotating the drill system 200, in addition to rotating them by the motor 208.

In general, there are three different configurations and/or operations that are carried out with the system 200: drilling, reaming and cementing. In a drilling position the Bottom-hole Assembly (BHA) sticks out completely of the liner for enabling the full measuring and steering capability (e.g., as shown in FIG. 2). In a reaming position, only the first disintegrating device (e.g., pilot bit 202) is outside the liner to reduce the risk of stuck pipe or drill string in case of well collapse and the remainder of the BHA is housed within the outer structure 250. In a cementing position the BHA is configured inside the outer structure 250 a certain distance from the second disintegrating device (e.g., reamer bit 251) to ensure a proper shoe track.

When performing downhole operations, using systems such as that shown and described above in FIGS. 1-2, it is advantageous to monitor what is occurring downhole. Some such solutions include wired pipe (WP) where monitoring is performed using one or more sensors and/or devices and collected data is transmitted via special drill pipes like a "long cable." Another solution has be employed communication via mud pulse telemetry (MPT), where the bore fluid is used as a communication channel. In such embodiments, pressure pulses are generated down hole (encoded), and a pressure transducer converts the pressure pulses into electrical signals (encoded). Mud pulse telemetry is in comparison with wired pipe very slow (e.g., by a factor of one thousand). One specific piece of information is location. This is particularly true when a downhole operation is desired to be performed at a very specific point along a wellbore, such as, but not limited to, packer deployment, reaming, underreaming, attaching or connecting the inner string to the outer string, and/or extending stabilizers, anchors, blades, slips, or hangers, etc.

Embodiments of the present disclosure are directed to downlink-activated setting tools for liner drilling applications or other applications with one structure within another (e.g., wireline application), wherein the one structure and the another structure may be moved by surface equipment, either in conjunction (e.g., jointly as a single movement) or independently from each other (e.g., moving one while the other is stationary). In the case of liner drilling applications, the liner and related completion equipment is carried downhole during the drilling operation (e.g., as shown in the arrangement of FIG. 2). In the case of wireline or other similar application, the wireline tool or other inner structure can be inserted into and conveyed through an outer structure to a location for a downhole operation to be performed.

In one non-limiting example, an inner structure has a hanger activation sub that is a drill string component and is connected to a bottomhole assembly bus system for power supply and communication. In this example, once the liner drilling system reaches a target depth within the borehole, the hanger activation sub is positioned proximate and/or at a liner hanger. The hanger activation sub, including the activation tool, which may be part of the inner structure, contains at least one packing element (also referred to herein as "inner engagement element") which generates a cavity inside an annulus formed between the inner structure and the outer structure and at a sensing element through at least one activation port in an interaction device in the liner hanger. To operate, circulating of mud is performed and a valve is opened to transfer a differential pressure from a center flow path, also referred to as "inner bore," of the hanger activation sub to the annulus and thus on a sensing element, such as a pressure sensing element (e.g., pressure sensor or activation piston) of the interaction device in the liner hanger. Once the hanger is set, at least one packing element (in some embodiment two packing elements) can be decompressed and the drill string (inner structure) is released from the liner (outer structure). By way of non-limiting example, the operation of the valve may be performed by alternative pressure transfer devices, such as a piston or a spindle valve that are mechanically, hydraulically, and/or electrically driven. In the instance of no mud flow within the borehole, a pumping device inside the inner structure may provide a differential pressure in order to activate the interaction device.

Figure 3:
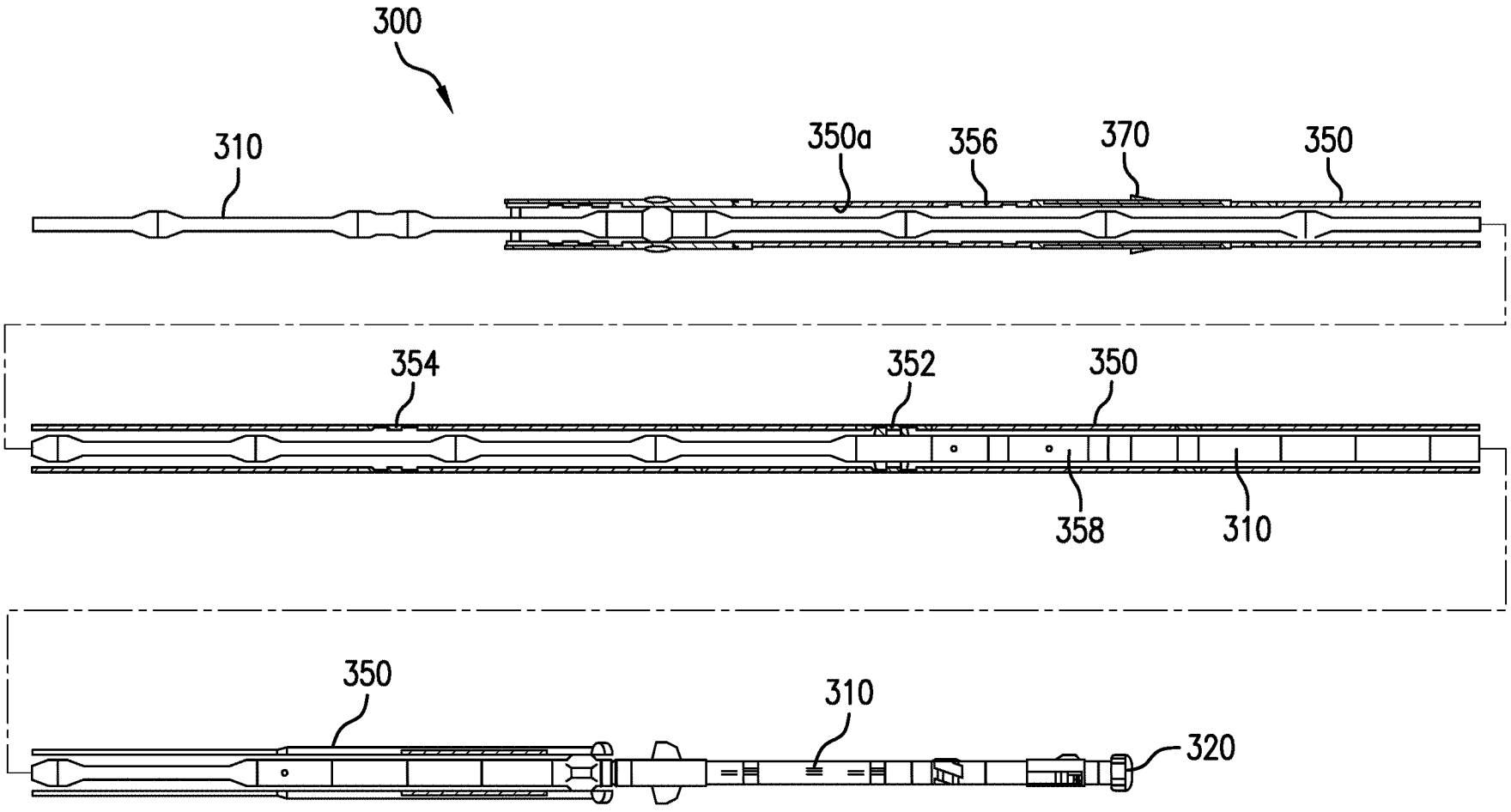
FIG. 3 is a schematic illustration of a downhole system having an inner structure that is moveable relative to an outer structure that can employ embodiments of the present disclosure.

Turning now to FIG. 3, a schematic illustration of a system 300 in accordance with an embodiment of the present disclosure is shown. In this embodiment, similar to that described above, an inner structure 310 is adapted to pass through an outer structure 350 driven by surface equipment and connected to the inside 350*a* of the outer structure 350 at a number of spaced apart locations (also referred to herein as the "landings" or "landing locations"). The shown embodiment of the outer structure 350 includes three landings, namely a lower landing 352, a middle landing 354 and an upper landing 356. In yet another embodiment, there may be one, two, three, or more landings. The inner structure 310 includes a drilling assembly 320 located on a lower end thereof, similar to that shown and described above.

As noted above, the inner structure 310 can interact with the outer structure 350, such as through engagement between an inner downhole tool 358, such as a hanger activation sub, that is part of the inner structure 310 and a portion of the outer structure 350, such as a hanger 370. In some embodiments, as noted, the inner downhole tool 358 is a downlinkable hanger activation sub that can extend and/or interact with a portion of the outer structure 350. Although shown and described herein with respect to an engagement between a hanger activation sub (of the inner structure) and a hanger (of the outer structure), those of skill in the art will appreciate that any type of downhole operation and/or tool arrangement can employ embodiments of the present disclosure.

Turning now to FIGS. 4A-4D, schematic illustrations of an operation in accordance with a non-limiting embodiment of the present disclosure are shown. FIGS. 4A-4D represent a sequence for operation of a hanger activation sub, including an activation tool 402, which operates upon an interaction device 404. The activation tool 402 is part of an inner structure 406 that is moveable within and through an outer structure 408 that includes the interaction device 404. One or more parts of the inner structure 406, including the activation tool 402, can be operated to act upon, engage with, or otherwise interact with part of the outer structure 408, such as an inner surface 408*a* of the outer structure 408 and/or the interaction device 404.

The interaction of the activation tool 402 with the interaction device 404 in the outer structure 408 may be facilitated through a mechanical, electrical, acoustic, and/or optical interaction. The activation tool 402 includes an inner engagement element. The inner engagement element includes at least one of an extendable element, an electrical element, an acoustic element, and/or an optical element. The extendable element(s) may be a packer, a snorkel, a piston, a gripper, a blade, a rod, and/or a rib. The electrical, acoustic, and/or optical elements may be electrical, acoustic, and/or optical signal transmitters, respectively. In the case of a mechanical activation of the interaction device 404, a sensor may be arranged within the interaction device 404 that is capable of detecting mechanical movement. The mechanical activation may be detected by a button type sensor or other types of sensors of varying complexity, such as load sensors (e.g., pressure, torque, bending load, etc.). In the case of electric, acoustic, and/or optical activation of the interaction device 404, electric sensors (e.g., capacitive, inductive, galvanic, etc.), acoustic sensors (e.g., piezoelectric sensors, tuning forks, etc.), and/or optical sensors (e.g., diodes, etc.) may be incorporated into the interaction device 404.

The inner structure 406 and the outer structure 408, as shown, are conveyed through a host casing 410 that is disposed within a borehole 412 created in a formation 414. One or both of the inner structure 406 and the outer structure 408, in some embodiments, can include drill bits or other tools, such as shown in FIGS. 2-3. A tool annulus 416 is formed between an exterior of the inner structure 406 and the inner surface 408*a* of the outer structure 408. It may be advantageous to have the outer structure 408 secured with respect to the host casing 410. However, at other times, the outer structure 408 needs to be moveable with respect to the host casing 410. As such, an engagement or securing mechanism must be able to be actuated only when desired, such as at specific locations. Accordingly, the system 400 includes the activation tool 402 as part of the inner structure 406 that is operable upon the interaction device 404 of the outer structure 408.

Figure 4A:
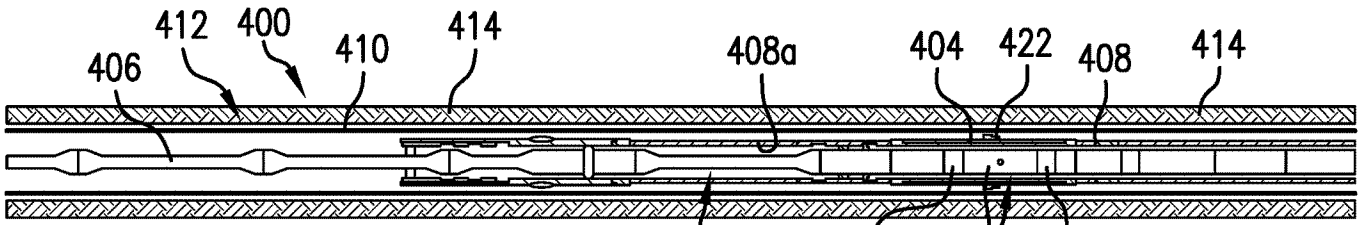
FIG. 4A is a schematic illustration of a downhole system in accordance with an embodiment of the present disclosure.
Figure 4B:
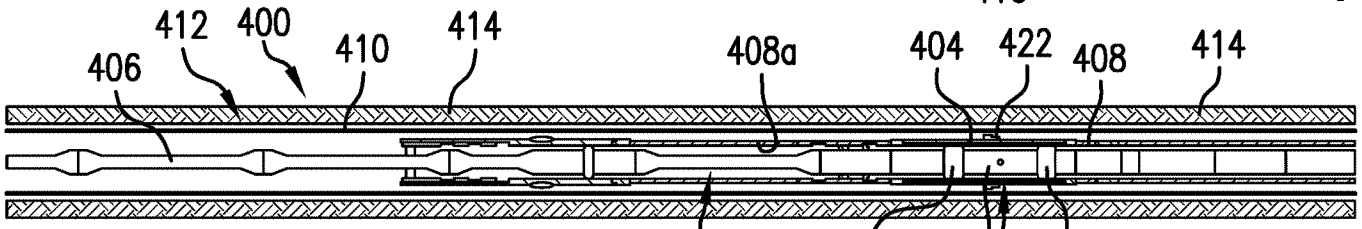
FIG. 4B is a schematic illustration of the system of FIG. 4A showing a first step of operation of the system.

In this embodiment, the activation tool 402 includes a first inner engagement element 418 and a second inner engagement element 420. The interaction device 404 includes one or more outer engagement elements 422. As shown in FIG. 4A, the activation tool 402 is positioned at the interaction device 404 with the inner engagement elements 418, 420 positioned above and below activation port of the sensing element of the interaction device 404 to enable isolation of a portion of the tool annulus 416. In general, the one or more inner engagement elements 418, 420 are configured to isolate a portion of the tool annulus about the activation port of the sensing element of the interaction device 202. The activation tool 402 can include electronics and/or be operably connected to an electronics module that can send/receive communications along a communication line, and thus can be in communication with surface equipment (e.g., control unit 40 in FIG. 1).

Although the embodiment of FIG. 4A illustrates (and describes) a two-packer arrangement to isolate an annulus shaped portion formed between the inner structure and the outer structure, various other shaped portions and/or shaped flow barriers can be employed without departing from the scope of the present disclosure. For example, in a non-limiting embodiment, it may be sufficient to build a localized flow barrier between a valve in the activation tool of the inner structure and a flow port of the interaction device in the outer structure. Such flow barrier may not span around an entire annulus, but rather, may be implemented to employ only a portion of the annulus between the inner and outer structures, such as a channel shape connection (e.g., a cylinder) between the location of the valve in the activation tool of the inner structure and the activation tool portion of the interaction device of the outer structure. Such channel-shaped connection may run through the annulus.

In operation, the activation tool 402 can receive instructions through a downlink. The instructions can be to perform an interaction operation, such as extension of the outer engagement elements 422 to operably connect the outer structure 408 to the host casing 410. Upon receiving instructions, the inner engagement elements 418, 420 can be operated to isolate a portion of the tool annulus to form an isolated annulus or cavity 416*a*. The inner engagement elements 418, 420 can be packer-type elements that are expandable or compressible such that a portion of the inner engagement elements 418, 420 can engage with the inner surface 408*a* of the outer structure 408 and form the isolated annulus or cavity 416*a*. In one non-limiting example, the inner engagement elements 418, 420 are compressed or squeezed to expand outward into engagement with the inner surface 408*a*. Such engagement between the inner engagement elements 418, 420 and the inner surface 408*a* at the interaction device 404 is illustratively shown in FIG. 4B, with the isolated annulus or cavity 416*a* defined between the activation tool 402 and the inner surface 408*a* at the interaction device 404.

Figure 4C:
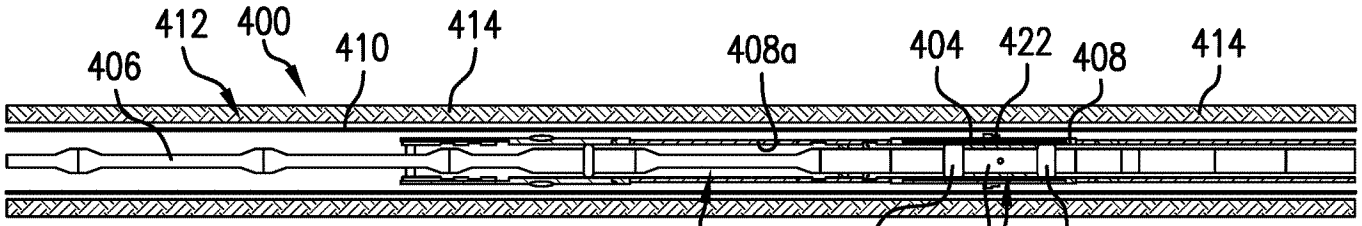
FIG. 4C is a schematic illustration of the system of FIG. 4A showing a second step of operation of the system.

As shown in FIG. 4C, the isolated annulus or cavity 416*a* is filled with borehole fluid. The isolated annulus or cavity 416*a*, in this embodiment, is pressurized by using the higher pressure inside the inner bore of the inner structure by transferring a fluid such as, but not limited to, mud, water, formation or production fluid, etc. supplied through a valve of the activation tool 402. The mud within a pressurized annulus or cavity 416*b* generates a differential pressure at the interaction device 404 and the one or more outer engagement elements 422 will actuate. The differential pressure is at the interaction device 404. For example, a valve in the activation tool 402 allows fluid flow from an inner bore into an isolated annulus or cavity. The differential pressure is then present at the interaction device 404. The side of the interaction device 404 that faces the inner annulus experiences a different pressure than the side of the interaction device 404 that faces the outer annulus. In this case, the one or more extendable elements, also referred to as outer engagement elements 422, will extend outward from the interaction device 404 of the outer structure 408 and into engagement with the host casing 410, as shown in FIG. 4C. By non-limiting example, the outer engagement element may be at least one of a slip, an anchor, a piston, a blade, a rib, a tong, and/or a gripper. In some embodiments, the outer structure may include a power source, such as a battery or alternative power storage device, with such power source arranged to provide energy to the outer engagement elements, if required.

In some embodiments of the present disclosure, one or more of the outer engagement elements may be arranged to interact with an exterior structure, such as a borehole formation, a cement volume, etc. The interaction in such embodiments may be at least one of formation evaluation (FE) measurements and/or cement bond measurements. The outer engagement element(s) of such embodiments may include measurement sensors, for example including at least one of a temperature sensor, a pressure sensor, a resistivity sensor, a gamma radiation sensor, a nuclear sensor, a nuclear magnetic resonance sensor, and/or a formation sampling sensor. The acquired data may be stored in a non-volatile memory in the outer structure for later retrieval and/or processing.

Figure 4D:
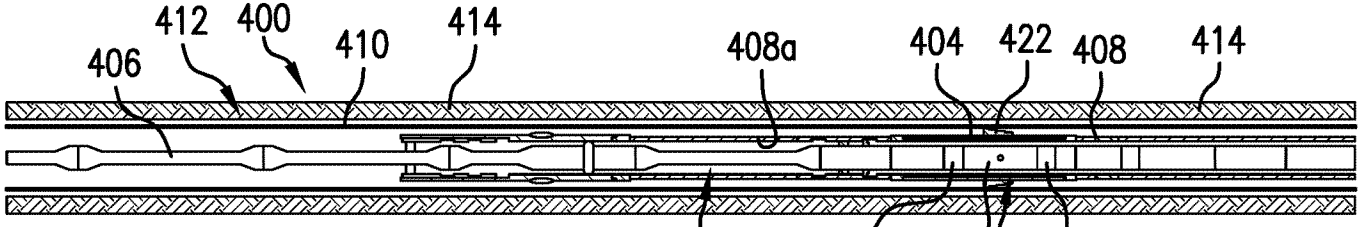
FIG. 4D is a schematic illustration of the system of FIG. 4A showing a third step of operation of the system.

Once the one or more outer engagement elements 422 are activated or actuated, the activation tool 402 can be operated to close the valve and/or can operate to disengage the inner engagement elements 418, 420 from the inner surface 408*a*, allowing the mud to disperse within the tool annulus 416. As shown in FIG. 4D, the tool annulus 416 is formed again without any interruption or isolated sections and is continuous along the length of the inner and outer structures 406, 408. After this operation, the inner structure 406 can be moved relative to the outer structure 408. Moreover, the above described operation can be performed again at a second location with the activation tool 402 interacting with a second interaction device similar to the interaction device 404, at a different location along the length of the outer structure 408.

In accordance with embodiments of the present disclosure, a downlink, electronic activation of an activation tool is provided to enable and perform a downhole operation where the activation tool interacts with and/or operates upon an interaction device. For example, a liner setting operation can be initiated using electronic activation through a downlink and an activation tool (e.g., part of an inner drill string, wireline tool) that is within an outer structure (e.g., an outer string, liner, etc.) can actuate or operate to cause an operation or action by the outer structure to thus engage and set with a liner. The activation tool acts in response to electronic instructions sent through a downlink from a surface controller to perform a downhole operation. Advantageously, embodiments of the present disclosure replace traditional drop-ball operations with a faster downlink communication and thus improved operation times and/or repeatable operations can be carried out downhole.

Downhole operations that are electronically initiated through a downlink are achieved using an activation tool (e.g., inner drill string, wireline tool, etc.) acting upon an interaction device (e.g., a portion of an outer string, liner, casing, etc.). In accordance with a non-limiting embodiment, an activation tool or part thereof of an inner structure is downlink activated to operate and perform a first action that induces a second action that is performed by an interaction device in an outer structure that the inner structure is within.

In one non-limiting example, a downlink instruction can be transmitted by a transmitter from the surface to perform a liner setting operation. In this case, the downlink is received by an inner structure, the inner structure having a valve section including a valve positioned between or near one or more optional inner engagement elements. The valve section can be arranged to be controllable in response to a downlink. The inner engagement elements can seal a volume (e.g., an annulus between the inner structure and the outer structure). The valve is operated (in response to the downlink instructions) to increase pressure near the inner engagement elements by transferring the fluid and thus perform a downhole operation. In various embodiments, the valve can control, for example, hydraulic fluid or drilling mud. An altered pressure, such as an increased or decreased pressure, between the activation tool and the interaction device acts to operate one or more features on/of the interaction device (e.g., liner hanger elements, attachment devices, slips, etc.).

As will be appreciated by those of skill in the art, embodiments of the present disclosure can be used to perform any downhole tool activation operation and the present disclosure is not limited to packers/hanger arrangements. Embodiments of the present disclosure are directed to operations which are taking place outside or external to the outer structure or the interaction device, such as done by liner hanger subs, as described herein. Further, embodiments can be used to perform activation operation(s) in multiple locations along an outer structure using a single activation tool of an inner structure.

As described herein and with respect to one non-limiting embodiment below, apparatuses and methods for downlink activation of downhole equipment to perform a downhole operation are provided. Generally, embodiments are directed to positioning an activation tool of an inner structure inside or close to an activation port of an interaction device of an outer structure, the activation device to be activated by operation of the activation tool. In one example, compressing two inner engagement elements (e.g., packing elements) generates an isolated annulus or cavity between the inner structure and the outer structure, such as between the activation tool and the interaction device. A valve of the inner structure is operated to enable connection (e.g., hydraulic) between an inner diameter of the interaction device to an exterior or external component of the interaction device. The hydraulic connection enables operation of the external component. For example, by allowing fluid flow through the valve, a differential pressure is generated within the annulus or cavity. The differential pressure will then hydraulically activate a component or element of the interaction device such that an operation can be performed external to the interaction device.

In various embodiments, as described herein, during downhole operations prior to activation of and/or interaction with the interaction device, the valve of the activation tool can be protected from debris and other contamination by filling an annulus around the inner structure or any other geometrical type of cavity associated with the inner structure with oil and sealing it with a rubber membrane, a piston, a bellow, or any other kind of flexible barrier towards the annulus or cavity between the inner and outer structures. Further, in some embodiments, the differential pressure generated within the annulus or cavity between the inner and outer structures to operate the interaction device can be supplemented by operation of pulser valves that can be used as adjustable chokes to adjust the differential pressure within the annulus or cavity. Further, an optional packing element can be used as a pressure seal for the annulus or cavity during a cementing operation. Moreover, deactivation of arrangements of the present disclosure, such as deactivation of the flow barrier, can be achieved by moving the inner structure relative to the outer structure, and thus easy disengagement or deactivation can be achieved. Alternatively, deactivation may be achieved by using, again, differential pressure variations.

Figure 5A:
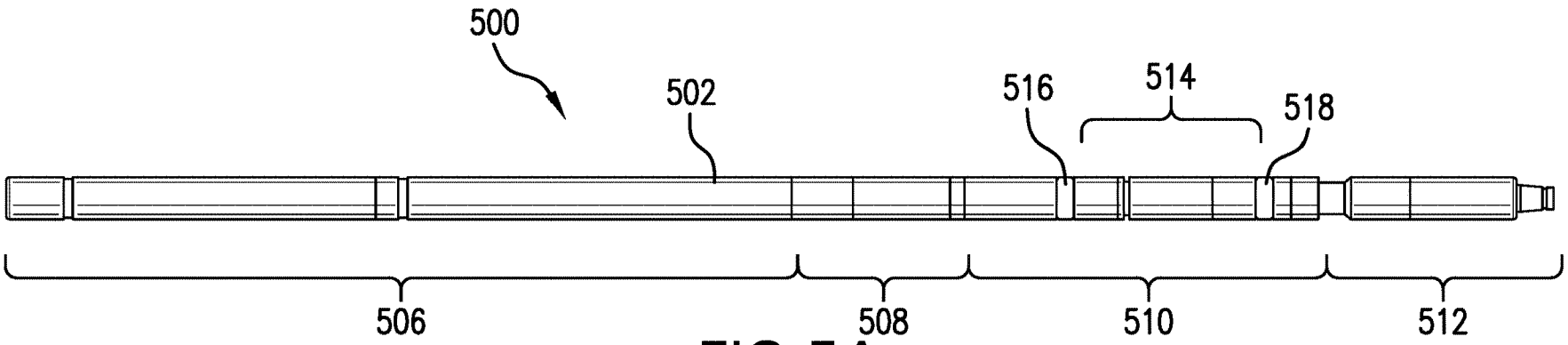
FIG. 5A is a schematic illustration of an inner structure of a system in accordance with an embodiment of the present disclosure.
Figure 5B:
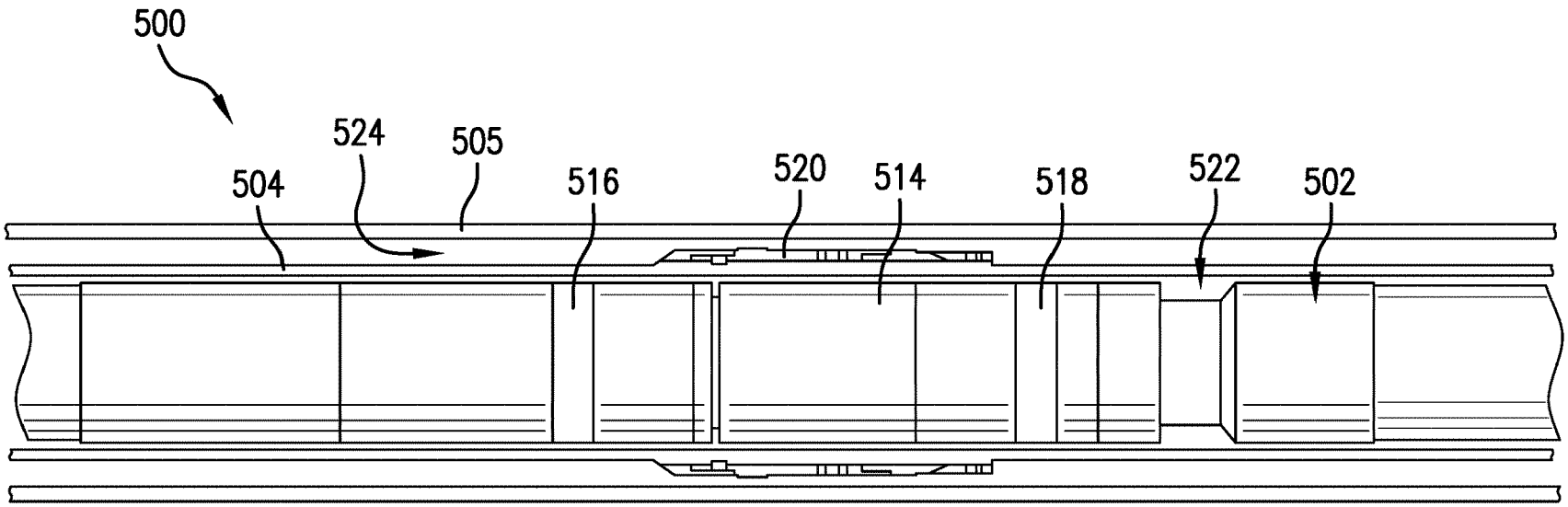
FIG. 5B is a schematic illustration of the inner structure shown in FIG. 5A as housed within an outer structure in accordance with an embodiment of the present disclosure.

Turning now to FIGS. 5A-5B, example illustrations of an inner structure 502 and an outer structure 504 of a system 500 in accordance with an embodiment of the present disclosure are shown. FIG. 5A illustrates various features and components of the inner structure 502 and FIG. 5B illustrates a portion of the inner structure 502 within the outer structure 504, which is all run within an exterior feature or structure 505 (e.g., formation, borehole, host casing, another liner, etc.). As shown in FIG. 5B, the inner structure 502 can be run within the outer structure 504, and in various arrangements, the inner structure 502 is movable within and relative to the outer structure 504.

The inner structure 502 has a control section 506, a valve section 508, and an activation section 510. Below the sections 506, 508, 510 can be one or more components of a bottomhole assembly 512 or other downhole component(s). Although shown as three separate sections, those of skill in the art will appreciate that various alternative arrangements are possible without departing from the scope of the present disclosure. For example, one or more of the control section 506, the valve section 508, and/or the activation section 510 can be integrally formed into a single structure or various of the functions can be incorporated into other parts of the inner structure 502 at different locations. As shown, the activation section 510 includes an activation tool 514 that is positioned between first and second inner engagement elements 516, 518.

As shown in FIG. 5B, the inner structure 502 is positioned within the outer structure 504. Further, the outer structure 504 is disposed within the exterior feature 505, shown as a host casing. Although shown and described as a casing, those of skill in the art will appreciate that the outer structure 504 can pass into and through various other structures/features, such as a borehole or wellbore, tubular, another liner, etc. The outer structure 504 includes an interaction device 520 that is part of and/or located on an outside or exterior of the outer structure 504. When arranged as shown in FIG. 5B, an inner annulus 522 is formed between the inner structure 502 and the outer structure 504. The inner annulus 522 is similar to the tool annulus 416 of FIGS. 4A-4D. An outer annulus 524 is formed between the outer structure 504 and the exterior feature 505.

In operation, a downlink command can be transmitted or communicated to the control section 506 of the inner structure 502. The transmission of the downlink instructions/command can be by mud pulse telemetry, electromagnetic telemetry, acoustic telemetry, wired pipe communication, or other downlink/downhole transmission technologies as known in the art. The control section 506 will then control the valve section 508 and/or the activation section 510 to perform a particular operation. In some embodiments, the control by the control section 506 can include controlling the valve section 508 to act upon the activation section 510. In one non-limiting example, the control section 506 controls the activation section 510 such that the inner engagement elements 516, 518 extend from the inner structure 502 into engagement with an inner surface of the outer structure 504, thus isolating the activation tool 514. The activation tool 514 can include one or more ports and can be in fluid communication with the valve section 508. When the portion of the inner annulus 522 around the activation tool 514 is isolated by the inner engagement elements 516, 518, the valve section 508 can control a fluid flow (e.g., hydraulic fluid, mud, etc.) into the inner annulus 522. As a fluid enters or leaves the inner annulus 522 a fluid pressure and/or differential pressure alters within the inner annulus 522, e.g., pressure increases or decreases.

As the differential pressure increases within the inner annulus 522, hydraulic force may be applied to the outer structure 504 and particularly the interaction device 520 (or a portion thereof). That is, by operating the activation tool 514, an interaction device 520 can be activated or operated to perform a downhole operation. In one non-limiting example, the interaction device 520 can include slips or other types of extension members that can be extended due to the differential pressure and thus extend from the outer structure 504 (and particularly the interaction device 520) into engagement with the exterior feature 505.

In accordance with one non-limiting embodiment, one function of the activation section 510 is to separate or block a hydraulic path between an upper area (above the activation section 510) and the lower area (below the activation section 510) of the inner annulus 522. Due to the existence of the two inner engagement elements 516, 518 it is possible to isolate a section of the inner annulus 522 and enable the activation section 510 (or activation tool 514) to connect a center bore pressure or fluid directly with the inner annulus 522 and/or the outer annulus 524 pressure level or fluid by opening a short circuit through the activation tool 514 and/or the interaction device 520 at a predefined location. This functionality may also be employed in an area where the inner structure 502 is sticking out of the outer structure 504 (e.g., as shown in FIGS. 2-3) and may seal or isolate an area against a borehole wall.

As noted above, the inner structure can be divided into three main sections. The control section 506, the valve section 508, and the activation section 510. The control section 506 houses electronics and, optionally, hydraulic fluids including a hydraulic fluid compensation reservoir. The valve section 508 consists of several pockets and/or elements, including, in some configurations, a mud valve. At the lower end of the valve section 508 is the activation section 510, shown having the two inner engagement elements (e.g., rubber packing elements) that are responsible to seal-off the inner annulus 522 between the inner and outer structures 502, 504, as described herein.

The control section 506 controls the activation and deactivation of the valve section 508 and the activation section 510 and/or subparts thereof. The control section 506 is a powered section of the inner structure 502 and can be powered by one or more powering mechanisms. For example, in some configurations, the control section 506 is powered by electrical power from a battery or a mudflow-driven alternator that is powered by a turbine, as will be appreciated by those of skill in the art. The electrical power can be transformed into hydraulic power by an electrical motor that drives a pump within the control section 506 (or located in another section of the inner structure 502). Further, the electrical power can be employed to power electronics, measuring devices, and/or control valves of one or more sections of the inner structure 502.

The activation section 510, and particularly the inner engagement elements 516, 518, is configured to enable sealing-off of the inner annulus 522 between the inner structure 502 and the outer structure 504. The inner engagement elements 516, 518 of the activation section 510 can be activated and deactivated separately or simultaneously. In some configurations of the present disclosure, the inner engagement elements 516, 518 can be operated by respective pistons. These pistons can be controlled individually by associated activation lines as described below. Accordingly, a creation of a simple barrier for mud flow can be achieved if only one of the engagement elements 516, 518 is activated (e.g., compressed) or of an isolated zone between both inner and outer structures 502, 504 if both inner engagement elements 516, 518 are activated (e.g., compressed) simultaneously. In some non-limiting embodiments, the inner engagement element may be a packer which may be hydraulically or pneumatically inflatable (inflatable packer) or may be a mechanically activated packer (mechanical packer).

Figure 6A:
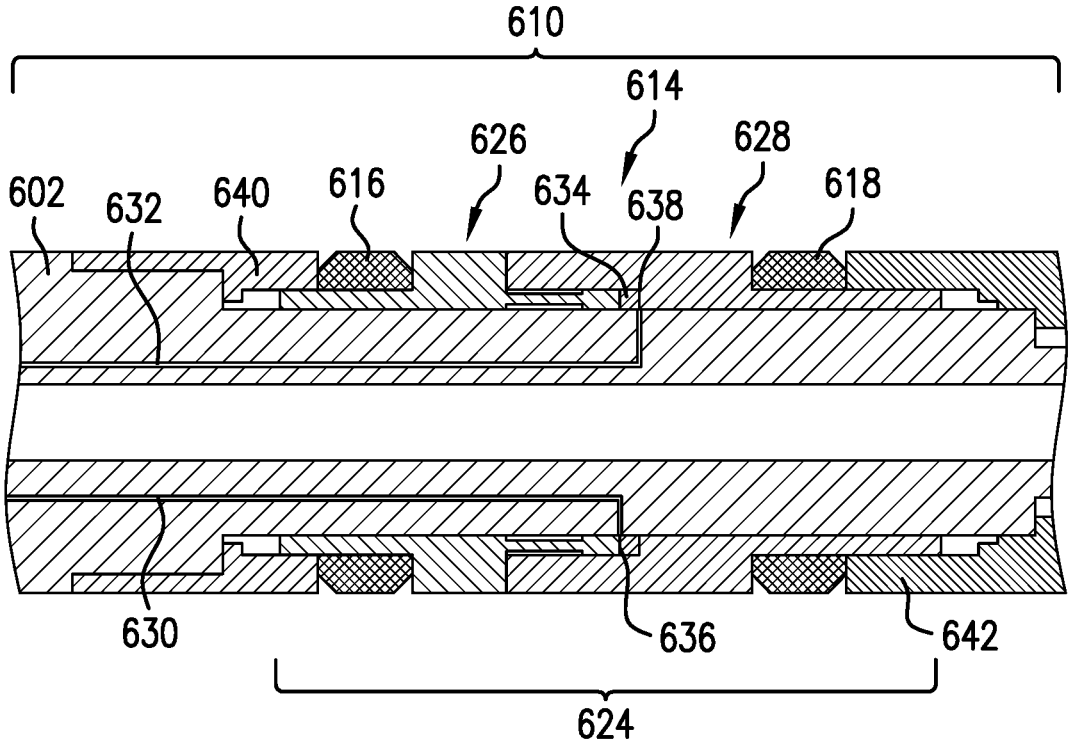
FIG. 6A is a schematic illustration of an activation section of an inner structure in accordance with an embodiment of the present disclosure, in a disengaged state.
Figure 6B:
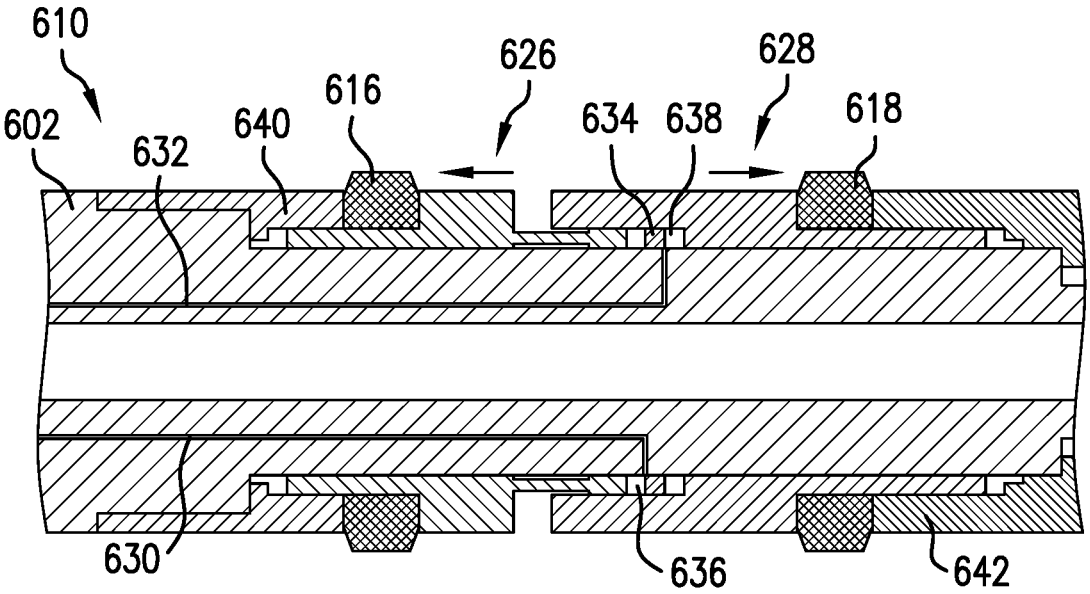
FIG. 6B is a schematic illustration of the activation section of FIG. 6A in an engaged state and illustrating a transition from the disengaged state to the engaged state.
Figure 6C:
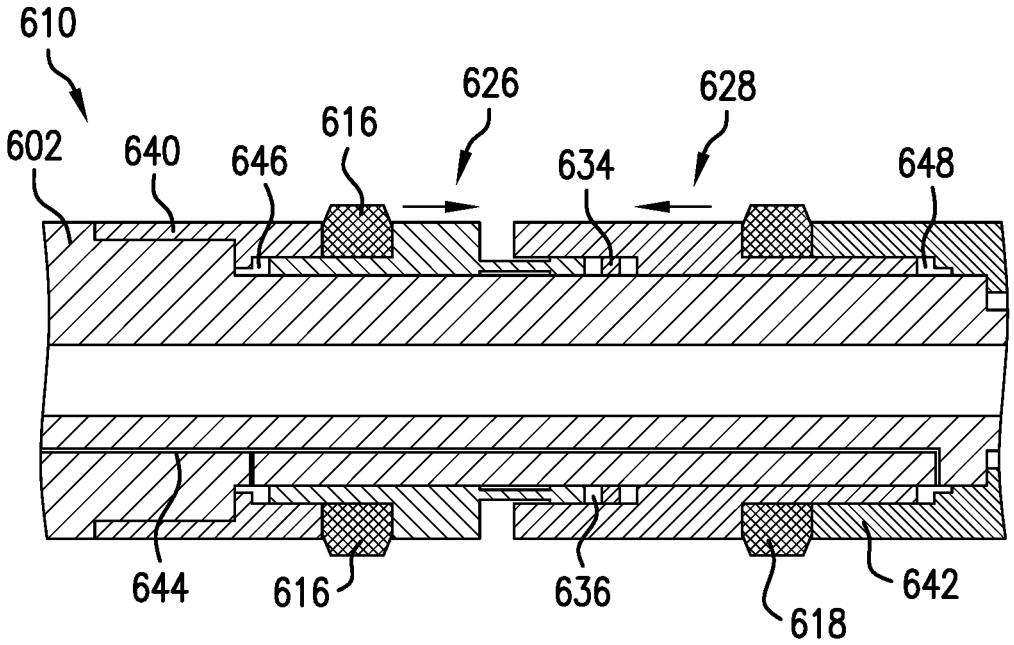
FIG. 6C is a schematic illustration of the activation section of FIG. 6A in an engaged state and illustrating a transition from the engaged state to the disengaged state.

FIGS. 6A-6C are schematic illustrations of an activation section 610 in accordance with the present disclosure. More particularly, FIGS. 6A-6C illustrate operation and/or activation of inner engagement elements 616, 618 of an activation tool 614 of an activation section 610 that is part of an inner structure 602 in accordance with an embodiment of the present disclosure. In this embodiment, two inner engagement elements 616, 618 are activated with FIGS. 6A-6C illustrating a sequence of activation. FIG. 6A illustrates the inner engagement elements 616, 618 in a deactivated position and FIGS. 6B-6C illustrated the inner engagement elements 616, 618 in an activated position. The inner structure 602 and activation tool 614 thereof can be disposed and moveable within an outer structure, such as shown and described above. As described above, the activation tool 614 can be engagable with an outer structure to form an isolated annulus or cavity. To achieve this, the activation tool 614 of FIGS. 6A-6C includes the inner engagement elements 616, 618. Extension and thus engagement of the inner engagement elements 616, 618, in this embodiment, is performed through operation of a piston assembly 624 having a first piston 626 and a second piston 628.

The pistons 626, 628 are actuated by fluid pressure that is supplied through respective first and second fluid lines 630, 632. The fluid lines 630, 632 fluidly connect a fluid source (not shown), such as a hydraulic fluid source, with cavities that are formed between the respective pistons 626, 628 and a middle stop element 634. The middle stop element 634, as shown, is a ring that is fixed to the inner structure 602 and the pistons 626, 628 are moveable relative to the inner structure 602. A first fluid line 630 provides fluid into a first activating chamber 636 that receives fluid to hydraulically actuate the first piston 626 away from the middle stop element 634 and toward the first inner engagement element 616. Similarly, a second fluid line 632 provides fluid into a second activating chamber 638 that receives fluid to hydraulically actuate the second piston 628 away from the middle stop element 634 and toward the second inner engagement element 618. The first inner engagement element 616 is compressible between the first piston 626 and an upper stop element 640. Similarly, the second inner engagement element 618 is compressible between the second piston 628 and a lower stop element 642. When fluid enters first activating chamber 636, the fluid acts upon the first piston 626 and urges the first piston 626 to the left in FIG. 6A. When fluid enters second activating chamber 638, the fluid acts upon the second piston 628 and urges the second piston 628 to the right in FIG. 6A.

Accordingly, in some embodiments, the first piston 626 is moved to the left (e.g., uphole) and the second piston 628 is moved to the right (e.g., downhole) during an activating operation. In the present arrangement, self-reinforcement is achieved when external pressure is applied between both inner engagement elements 616, 618. However, in some embodiments, this can be changed if the pressure situation is different in any other application where the pressure from the outside is higher than between the inner engagement elements 616, 618.

As noted, located between the pistons 626, 628 is the middle stop element 634 that is fixed to the inner structure 602. The middle stop element 634 serves as a sealing holder to divide both activating chambers 636, 638 and ensures a defined end position of the pistons 626, 628. The middle stop element 634 prevents an imbalance of the pistons 626, 628 during a deactivation operation of the inner engagement elements 616, 618. This is because one piston 626, 628 can stay at least partially activated while the respective other piston 626, 628 moves back into a deactivated position. Further, the end positions of the activated pistons 626, 628 are defined by the respective upper stop element 640 and lower stop element 642, which can be adjusted if necessary. The upper and lower stop elements 640, 642 can prevent overstraining of the inner engagement elements 616, 618 when the inner engagement elements 616, 618 are compressed, as shown in FIGS. 6B-6C.

As illustratively shown in FIG. 6B, an activation operation is schematically shown. Fluid is conveyed into the first activating chamber 636 along the first activating fluid line 630. Similarly, fluid is conveyed into the second activating chamber 638 along the second activating fluid line 632. The fluid can be supplied from a control section of the inner structure 602, such as described above. The fluid can be supplied in response to a downlink instruction received by the control section from a surface controller or control unit.

As the fluid pressure and/or volume increases in the first and second activating chambers 636, 638, the first and second pistons 626, 628 are urged away from the middle stop element 634. The first piston 626 is urged to the left and applies pressure upon the first inner engagement element 616 which is bound by the upper stop element 640. Accordingly, the first inner engagement element 616 is compressed and expands outward from the activation tool 614, and thus can engage with a surface of an exterior structure (e.g., outer structure described above). The second piston 628 is urged to the right and applies pressure upon the second inner engagement element 618 which is bound by the lower stop element 642. Accordingly, the second inner engagement element 618 is compressed and expands outward from the activation tool 614, and thus can engage with a surface of an exterior structure (e.g., outer structure described above).

To deactivate the inner engagement elements 616, 618, a reverse operation can be performed, as shown in FIG. 6C. As schematically shown, an optional deactivating fluid line 644 can be fluidly connected to first and second deactivating chambers 646, 648 are provided and can be supplied with fluid similar to that described above. In some embodiments, the inner engagement elements 616, 618 can be formed of rubber or other spring-like material (or include a mechanical biasing element) and naturally deactivate or retract due to a mechanical behavior of the engagement elements. As such, the pistons 626, 628 are pushed back toward the deactivated (e.g., neutral) position once the pressure from the activating fluid lines 630, 632 is released. However, as noted, optional deactivating chambers 646, 648 can provide additional forces to deactivate the inner engagement elements 616, 618 and/or in case of a malfunction within the activation tool 614, such as jammed pistons. As schematically shown, a single deactivating fluid line 644 is fluidly connected to both the first and second deactivating chambers 646, 648. However, those of skill in the art will appreciate that multiple fluid lines can be employed (similar to the first and second activating fluid lines 630, 632). As such, hydraulic deactivation can, optionally, be performed on one or both of the inner engagement elements 616, 618.

As noted, the inner engagement elements 616, 618 can provide sealing functionality. For example, a pressure seal functionality provided by the first inner engagement element 616 (e.g., upper or uphole engagement element) can be used during a cementing operation. When a single engagement element is activated, deactivation can be achieved by relative movement between the inner structure 602 and an outer structure to which the engagement element may be engaged. This is advantageous because communicating with the activation tool 614 may not be possible upon completion of a cementing operation. In such a deactivating operation, when the first inner engagement element 616 is activated and the inner structure 602 is pulled upwards relative to an outer structure, the first inner engagement element 616 element compresses any fluid in the respective first activating chamber 636 which leads to a pressure peak. The pressure peak can be detected by a pressure transducer in the activation tool 614 (e.g., a hydraulic unit) and a deactivation routine can be performed.

Figure 7A:
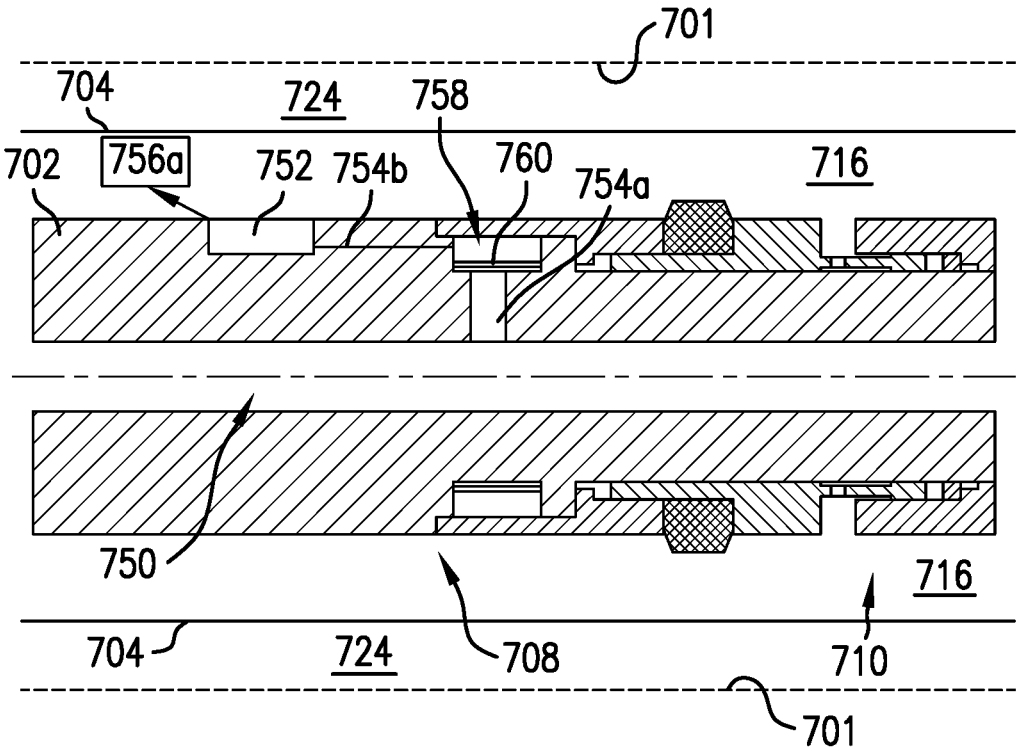
FIG. 7A is a first view of a valve section of an inner structure in accordance with an embodiment of the present disclosure.
Figure 7B:
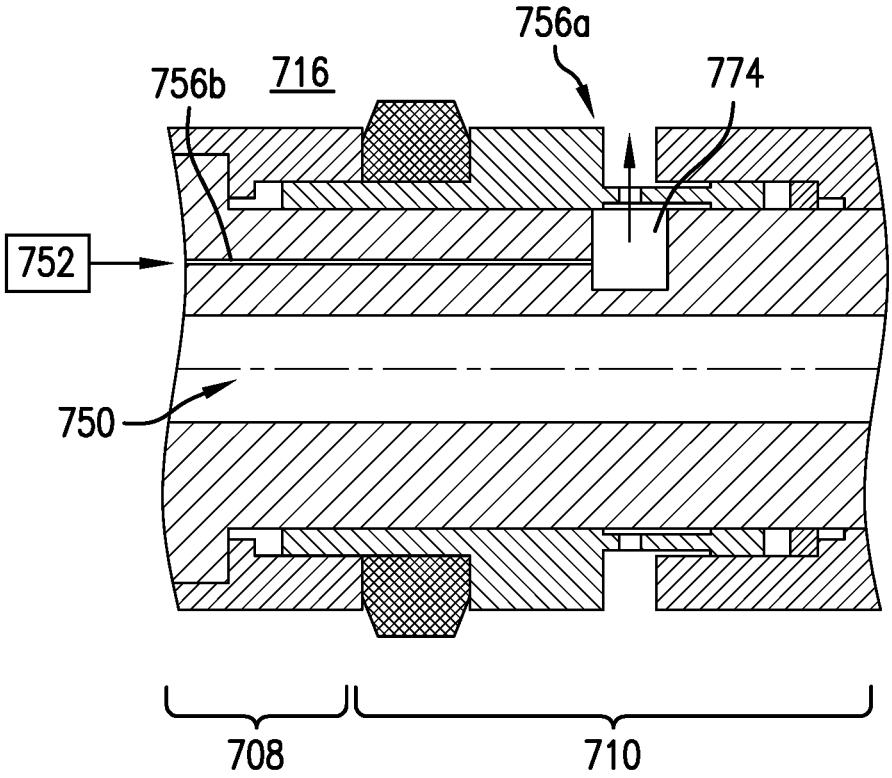
FIG. 7B is a second view of the valve section of FIG. 7A.

Turning now to FIGS. 7A-7B, schematic illustrations of a valve section 708 in accordance with an embodiment of the present disclosure are shown. FIG. 7A illustrates a first view of the valve section 708, illustrating an inlet arrangement of the valve section 708. FIG. 7B illustrates a second view of the valve section 708, illustrating an outlet arrangement of the valve section 708.

The valve section 708 is part of an inner structure 702, for example, as shown and described above. The inner structure 702 is disposed within and moveable along an outer structure 704 and a tool annulus 716 is formed between the inner structure 702 and the outer structure 704. The inner structure 702 includes a center flow path 750. The center flow path 750 can be used to convey drilling fluids, mud, hydraulic fluids, etc. from one location to another through the inner structure 702. As shown, the valve section 708 is located proximate an activation section 710 similar to that shown and described above. The valve section 708 includes a valve 752 that is fluidly connected to the center flow path 750.

The valve 752 is responsible to connect the center flow path 750 of the inner structure 702 with the tool annulus 716 that is present between the inner structure 702 and the outer structure 704. The valve 752 is configured to allow the transmission of fluid and/or pressure if one area has a higher pressure level than another.

For example, the pressure within the center flow path 750 can be higher than the pressure within the tool annulus 716. This may be a normal condition when a mud flow is on and the mud is circulated through the center flow path 750 of the inner activation tool and then uphole through the tool annulus 716 and/or uphole through an annulus formed between an exterior of the outer structure 704 and a borehole wall 701 (i.e., outer annulus 724). However, due to pressure losses at one or more restrictions and/or pressure losses due to frictional forces, there may be a differential pressure between the center flow path 750 and the tool annulus 716 and/or between the center flow path 750 and the outer annulus 724.

In another example, a pressure within the center flow path 750 can be equal to a pressure within the tool annulus 716. This status occurs when the circulation is off and there is also no movement of the inner structure 702, considering a homogenous fluid along the entire fluid column.

In another example, a pressure within the center flow path 750 can be lower than a pressure within the tool annulus 716. This condition may be rare, but it can occur if the fluid is inhomogeneous or during a tripping operation due to displacement forces if the inner structure 702 and/or the outer structure 704 is lowered very fast into the wellbore.

For activating an interaction device of the outer structure 704 (e.g., interaction device 404 of FIG. 4), the first described condition above is employed and the pressure is transmitted from the center flow path 750 to the tool annulus 716 (when isolated as described above) at a predefined position of the interaction device of the outer structure 704. As shown, a valve inlet port 754*a* fluidly connects the center flow path 750 of the inner structure 702 to the valve 752 along an input line 754*b*. A valve outlet port 756*a* is on the outer side of the inner structure (FIG. 7B) with the valve outlet port 756*a* fluidly connecting the valve 752 and the center flow path 750 to the tool annulus 716 along an outlet line 756*b*. Both ports 754*a*, 756*a* are protected from sedimentation via a prefilled oil, grease, or fluid reservoir 758. Further, the valve inlet port 754*a* is equipped with a rubber bellow 760 that separates mud from oil. In the event of a packing element leakage, the bellow 760 can be pierced to provide unlimited fluid (e.g., mud) supply through the valve 752.

The valve outlet port 756*a*, as shown in FIG. 7B, is located at the outer diameter of the inner structure 702 (and particularly the outer diameter of the valve section 708). The outlet port 756*a* and outlet line 756*b* are protected by oil against sedimentation. In one non-limiting configuration, the outlet port 756*a* features an insert that is equipped with a pierced membrane 774. The membrane 774 opens once a differential pressure is applied to the membrane 774 and closes automatically once the differential pressure is relieved.

In some non-limiting embodiments, a differential pressure used to interact with the interaction device can be generated by a mud pump and/or a piston inside the inner structure. Further, in some embodiments, the rubber bellow may be replaced by a valve or piston. Such arrangement can enable fluid to move directly from a center flow path to the tool annulus in order to alter the pressure inside the annulus between the inner structure and the outer structure.

Figure 8:
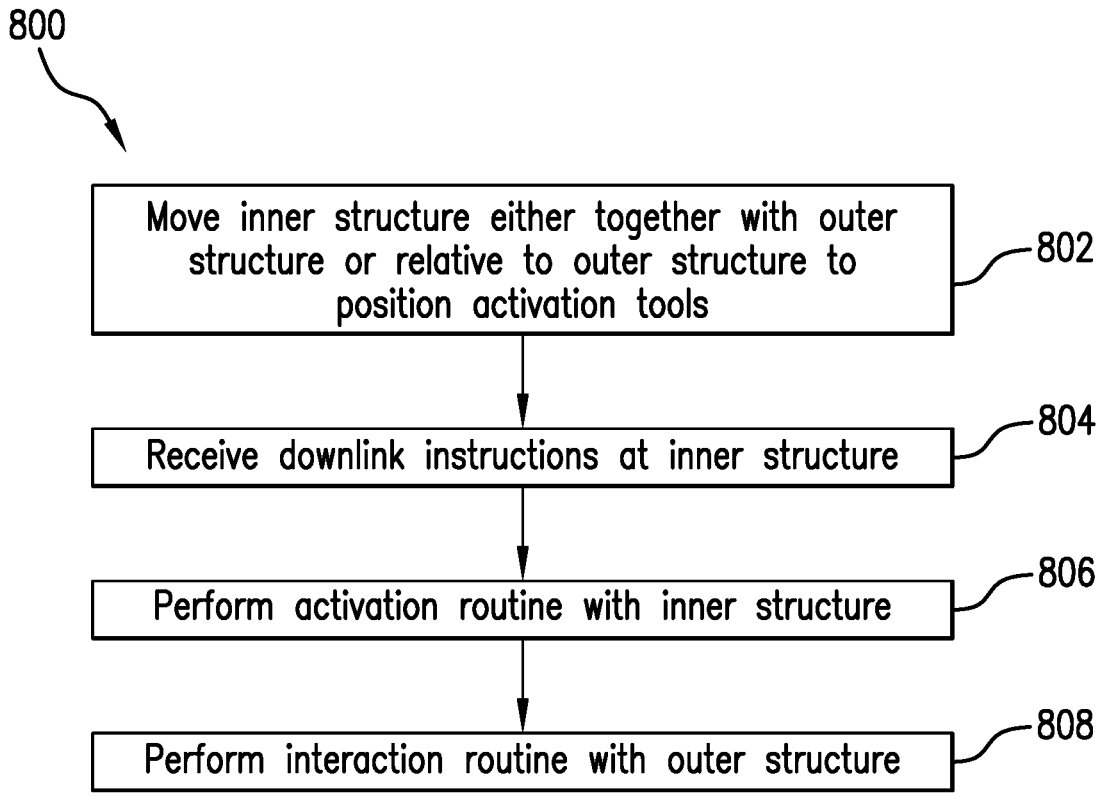
FIG. 8 is a flow process for performing a downhole operation in accordance with an embodiment of the present disclosure.

Turning now to FIG. 8, a flow process 800 for performing a downhole operation in accordance with the present disclosure is shown. The flow process 800 can be performed by downhole systems as shown and described herein. Particularly, the flow process 800 is performed downhole with an outer structure having at least one interaction device and an inner structure that is moveable within and relative to the outer structure, the inner structure having an activation tool. For example, in some embodiments, the outer structure can be an outer string and the inner structure can be an inner string, with the inner string being downlinkable and instructable to perform an action with the activation tool to cause an action by the interaction device. In other embodiments, the inner structure can be a wireline tool that is conveyed within a liner or other casing. Various other configurations are possible without departing from the scope of the present disclosure.

At block 802, the inner structure is moved downhole, either together with an outer structure or relative to an outer structure. The inner structure is moved such that the activation tool is aligned with the interaction device in a manner that enables operation as described herein. In some embodiments, the inner structure includes a control section, a valve section, and an activation section, with the activation tool being part of the activation section.

At block 804, a downlink instruction is sent to the inner structure. Such downlink can be by any known means of communication. The inner structure can include electronics to receive the downlink instructions.

At block 806, the inner structure performs an activation routine. The activation routine can be an operation of a valve, piston, and/or motor to generate a pressure differential within the inner structure and/or between a center flow path and a tool annulus that is formed between the inner structure and the outer structure. Alternatively, the differential pressure can be generated independently of the pressure in the center flow path by an electro-hydraulic system inside the inner structure. Other activation routines can be electronic, mechanical, hydraulic, and/or combinations thereof.

At block 808, the activation routine causes an interaction routine to be performed with the outer structure. The interaction routine can be initiated by a pressure differential caused by the activation routine.

The flow process 800 can be used to perform isolation routines with the inner structure relative to the outer structure, as described above, as an activation routine. Further, the interaction routine can be caused by pressure differentials formed within the tool annulus between the inner structure and the outer structure within the isolated area. The interaction routine can be an extension of components or some other action that is external to or "outside" the outer structure (e.g., within a borehole and interaction with a host casing, another liner, and/or formation wall).

Those of skill in the art will appreciate that embodiments of the present disclosure can be used to perform a hanger activation operation. In such an embodiment, the outer structure is or includes a liner hanger. The liner hanger, in some non-limiting embodiments, can be of any liner size, including, but not limited to, 7"/32# or 7"/26#.

In some embodiments, the activation section (e.g., activation section 610 of FIGS. 6A-6C) can include stabilizers for stabilizing relative to the outer structure. For example, with reference to FIGS. 6A-6C, the upper stop element and lower stop elements can be equipped with stabilizer pads. The stabilizer pads can be fixed to the activation section (and particularly the stop elements) with screws or other fasteners and can be replaced without disassembling the entire inner structure and/or complete sections thereof. In alternative embodiments, rather than the stabilizer pads just discussed, the inner structure can be configured with screw-on stabilizers, which are simple sleeves with a thread, as will be appreciated by those of skill in the art. In addition, those of skill in the art will appreciate that any number of inner engagement elements and/or inner structure tools can be configured along the length of the inner structure.

By way of non-limiting example, the inner engagement elements may be modular and/or exchangeable without disassembling the inner structure. Exchangeable inner engagement elements can allow for deployment of different packer sizes to serve different inner diameters of the outer structure. Packers may be made of various materials, including, but not limited to, natural rubber, different fluorinated elastomers (e.g., FKM, FFKM), nitrile butadiene rubbers (e.g., NBR, HNBR), etc. may address different drilling fluids, varying demanding drilling conditions, and/or varying temperature and/or pressure regimes. Using different end stop positions may allow adjustment to different inflated packer diameters.

In some non-limiting alternative embodiments, the inner engagement elements of the inner structure can be used to activate or deactivate part of an outer structure directly, as compared to being used to generate a differential pressure. For example, the inner engagement elements may be expanded to engage and/or grab a sleeve (i.e., the outer structure) and push or pull the sleeve to another position. In some embodiments the inner engagement elements may be mechanically extended (e.g., mechanical packer) rather than rely on a hydraulically operated piston configuration as described above. Further, in some embodiments, the radial force generated by the inner engagement elements (e.g., a blade or spear) can be used to push a portion of an outer structure directly, e.g., a switch or release mechanism.

In some embodiments, the ability to isolate a section of the tool annulus (or an annulus external to the inner structure) can enable fluid sampling. For example, the inner engagement elements can isolate an annulus in an open hole section or even in a perforated host casing to enable fluid sampling. The fluid sampling tools and components in such an embodiment would be part of the activation tool described herein. Further, such isolating can be used to isolate perforated areas or a simple hole, crack, etc. Another application for tools and arrangements in accordance with the present disclosure can be cleaning of an outer structure by wiping an inner diameter of the outer structure with the inner engagement elements of the inner structure.

Embodiment 1

A method to perform a downhole operation in a borehole, the method comprising: moving, using surface equipment, an inner structure and an outer structure within the borehole, the outer structure equipped with an interaction device and the inner structure configured to be moved relative to the outer structure in a direction parallel to the borehole by the surface equipment; transmitting, by a transmitter, a downlink instruction to the inner structure; and performing an interaction routine with the interaction device in response to the downlink instruction, wherein the interaction routine comprises an interaction at least partially outside of the outer structure to perform the downhole operation.

Embodiment 2

The method according to any of the embodiments described herein, wherein the inner structure comprises an activation tool, the method comprising performing an activation routine, the activation routine initiating the interaction routine in response to the downlink instruction.

Embodiment 3

The method according to any of the embodiments described herein, wherein the activation routine comprises creating a flow barrier in a portion formed between the inner structure and the outer structure.

Embodiment 4

The method according to any of the embodiments described herein, wherein the activation routine comprises altering a pressure within a portion formed between the inner structure and the outer structure.

Embodiment 5

The method according to any of the embodiments described herein, wherein the activation routine comprises activating at least one inner engagement element.

Embodiment 6

The method according to any of the embodiments described herein, wherein activating the at least one inner engagement element comprises expanding a packer element.

Embodiment 7

The method according to any of the embodiments described herein, wherein the at least one inner engagement element is at least one of an extendable element, an electrical element, an optical element, and an acoustic element.

Embodiment 8

The method according to any of the embodiments described herein, wherein the interaction routine comprises activating at least one outer engagement element.

Embodiment 9

The method according to any of the embodiments described herein, wherein the outer structure is a first liner and the at least one outer engagement element mechanically connects the first liner to at least one of the borehole, a second liner, and a casing.

Embodiment 10

The method according to any of the embodiments described herein, wherein the downlink instruction is transmitted by at least one of a mud pulse telemetry, an electromagnetic telemetry, an acoustic telemetry, and a wired pipe telemetry.

Embodiment 11

The method according to any of the embodiments described herein, wherein the inner structure is at least one of (i) removed from the outer structure after the interaction routine is performed, and (ii) moved within the outer structure prior to the interaction routine is performed.

Embodiment 12

A downlink activated system to perform a downhole operation, the system comprising: surface equipment for performing downhole operations; an outer structure operably connected to the surface equipment; an inner structure operably connected to the surface equipment and disposed within the outer structure, wherein the inner structure and the outer structure are moveable within a borehole by operation of the surface equipment, the outer structure including an interaction device and the inner structure is configured to be moved relative to the outer structure in a direction parallel to the borehole by the surface equipment; wherein the inner structure is configured to receive downlink instructions; and the interaction device is configured to perform an interaction routine in response to the downlink instruction, wherein the interaction routine comprises an interaction at least partially to an outside of the outer structure to perform the downhole operation.

Embodiment 13

The system according to any of the embodiments described herein, wherein the inner structure comprises an activation tool configured to perform an activation routine, the activation routine initiating the interaction routine in response to the transmitted downlink instruction.

Embodiment 14

The system according to any of the embodiments described herein, wherein the activation routine comprises at least one of creating a flow barrier in a portion formed between the inner structure and the outer structure and altering a pressure within a portion formed between the inner structure and the outer structure.

Embodiment 15

The system according to any of the embodiments described herein, wherein the outer structure is a first liner and the at least one outer engagement element mechanically connects the first liner to at least one of the borehole, a second liner, and a casing.

Embodiment 16

The system according to any of the embodiments described herein, wherein the inner structure includes a control section, a valve section, and an activation section.

Embodiment 17

The system according to any of the embodiments described herein, wherein the valve section includes a valve that is positioned between a center flow path within the inner structure and a portion formed between the inner structure and the outer structure.

Embodiment 18

The system according to any of the embodiments described herein, wherein the valve section is controllable to control at least one of a fluid pressure and a fluid flow of fluid from the center flow path and the portion formed between the inner structure and the outer structure.

Embodiment 19

The system according to any of the embodiments described herein, wherein the activation section includes at least one inner engagement element.

Embodiment 20

The system according to any of the embodiments described herein, wherein the at least one inner engagement element is a packer or an extendable element.

In support of the teachings herein, various analysis components may be used including a digital and/or an analog system. For example, controllers, computer processing systems, and/or geo-steering systems as provided herein and/or used with embodiments described herein may include digital and/or analog systems. The systems may have components such as processors, storage media, memory, inputs, outputs, communications links (e.g., wired, wireless, optical, or other), user interfaces, software programs, signal processors (e.g., digital or analog) and other such components (e.g., such as resistors, capacitors, inductors, and others) to provide for operation and analyses of the apparatus and methods disclosed herein in any of several manners well-appreciated in the art. It is considered that these teachings may be, but need not be, implemented in conjunction with a set of computer executable instructions stored on a non-transitory computer readable medium, including memory (e.g., ROMs, RAMs), optical (e.g., CD-ROMs), or magnetic (e.g., disks, hard drives), or any other type that when executed causes a computer to implement the methods and/or processes described herein. These instructions may provide for equipment operation, control, data collection, analysis and other functions deemed relevant by a system designer, owner, user, or other such personnel, in addition to the functions described in this disclosure. Processed data, such as a result of an implemented method, may be transmitted as a signal via a processor output interface to a signal receiving device. The signal receiving device may be a display monitor or printer for presenting the result to a user. Alternatively or in addition, the signal receiving device may be memory or a storage medium. It will be appreciated that storing the result in memory or the storage medium may transform the memory or storage medium into a new state (i.e., containing the result) from a prior state (i.e., not containing the result). Further, in some embodiments, an alert signal may be transmitted from the processor to a user interface if the result exceeds a threshold value.

Furthermore, various other components may be included and called upon for providing for aspects of the teachings herein. For example, a sensor, transmitter, receiver, transceiver, antenna, controller, optical unit, electrical unit, and/or electromechanical unit may be included in support of the various aspects discussed herein or in support of other functions beyond this disclosure.

The use of the terms "a" and "an" and "the" and similar referents in the context of describing the invention (especially in the context of the following claims) are to be construed to cover both the singular and the plural, unless otherwise indicated herein or clearly contradicted by context. Further, it should further be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The flow diagram(s) depicted herein is just an example. There may be many variations to this diagram or the steps (or operations) described therein without departing from the scope of the present disclosure. For instance, the steps may be performed in a differing order, or steps may be added, deleted or modified. All of these variations are considered a part of the present disclosure.

It will be recognized that the various components or technologies may provide certain necessary or beneficial functionality or features. Accordingly, these functions and features as may be needed in support of the appended claims and variations thereof, are recognized as being inherently included as a part of the teachings herein and a part of the present disclosure.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While embodiments described herein have been described with reference to various embodiments, it will be understood that various changes may be made and equivalents may be substituted for elements thereof without departing from the scope of the present disclosure. In addition, many modifications will be appreciated to adapt a particular instrument, situation, or material to the teachings of the present disclosure without departing from the scope thereof. Therefore, it is intended that the disclosure not be limited to the particular embodiments disclosed as the best mode contemplated for carrying the described features, but that the present disclosure will include all embodiments falling within the scope of the appended claims.

Accordingly, embodiments of the present disclosure are not to be seen as limited by the foregoing description, but are only limited by the scope of the appended claims.

What is claimed is:

1. A method to perform a downhole operation in a borehole, the method comprising:

moving, using surface equipment, an inner structure and an outer structure within the borehole, the outer structure equipped with an interaction device and the inner structure configured to be moved relative to the outer structure in a direction parallel to the borehole by the surface equipment, wherein the inner structure includes a control section, a valve section, and an activation section;

transmitting, by a transmitter, a downlink instruction to the inner structure; and performing an interaction routine with the interaction device in response to the downlink instruction, wherein the interaction routine comprises an interaction at least partially outside of the outer structure to perform the downhole operation.

2. The method of claim 1, wherein the activation section comprises an activation tool, the method comprising performing an activation routine, the activation routine initiating the interaction routine in response to the downlink instruction.

3. The method of claim 2, wherein the activation routine comprises creating a flow barrier in at least a portion of an annular region formed between the inner structure and the outer structure.

4. The method of claim 2, wherein the activation routine comprises altering a pressure within at least a portion of an annular region formed between the inner structure and the outer structure.

5. The method of claim 2, wherein the activation routine comprises activating at least one inner engagement element.

6. The method of claim 5, wherein activating the at least one inner engagement element comprises expanding a packer element.

7. The method of claim 5, wherein the at least one inner engagement element is at least one of an extendable element, an electrical element, an optical element, and an acoustic element.

8. The method of claim 1, wherein the interaction routine comprises activating at least one outer engagement element.

9. The method of claim 8, wherein the outer structure is a first liner and the at least one outer engagement element mechanically connects the first liner to at least one of the borehole, a second liner, and a casing.

10. The method of claim 1, wherein the downlink instruction is transmitted by at least one of a mud pulse telemetry, an electromagnetic telemetry, an acoustic telemetry, and a wired pipe telemetry.

11. The method of claim 1, wherein the interaction device comprises a sensing element.

12. A downlink activated system to perform a downhole operation, the system comprising:

surface equipment for performing downhole operations;

an outer structure operably connected to the surface equipment; and an inner structure operably connected to the surface equipment and disposed within the outer structure, wherein the inner structure and the outer structure are moveable within a borehole by operation of the surface equipment, the outer structure including an interaction device and the inner structure is configured to be moved relative to the outer structure in a direction parallel to the borehole by the surface equipment;

wherein the inner structure is configured to receive downlink instructions;

the interaction device is configured to perform an interaction routine in response to the downlink instruction, wherein the interaction routine comprises an interaction at least partially to an outside of the outer structure to perform the downhole operation; and wherein the inner structure includes a control section, a valve section, and an activation section.

13. The downlink activated system of claim 12, wherein the activation section comprises an activation tool configured to perform an activation routine, the activation routine initiating the interaction routine in response to the transmitted downlink instruction.

14. The downlink activated system of claim 13, wherein the activation routine comprises at least one of creating a flow barrier in a portion formed between the inner structure and the outer structure and altering a pressure within a portion formed between the inner structure and the outer structure.

15. The downlink activated system of claim 14, wherein the outer structure is a first liner and at least one outer engagement element mechanically connects the first liner to at least one of the borehole, a second liner, and a casing.

16. The downlink activated system of claim 12, wherein the valve section includes a valve that is positioned between a center flow path within the inner structure and at least a portion of an annular region formed between the inner structure and the outer structure.

17. The downlink activated system of claim 16, wherein the valve section is controllable to control at least one of a fluid pressure in the portion of the annular region formed between the inner structure and the outer structure and a fluid flow of fluid from the center flow path to the portion of the annular region formed between the inner structure and the outer structure.

18. The downlink activated system of claim 12, wherein the activation section includes at least one inner engagement element.

19. The downlink activated system of claim 18, wherein the at least one inner engagement element is a packer or an extendable element.

20. The downlink activated system of claim 12, further comprising a sensing element in the interaction device.

* * * * *